US008320808B2

(12) United States Patent
Yamada

(10) Patent No.: US 8,320,808 B2
(45) Date of Patent: Nov. 27, 2012

(54) IMAGE FORMING APPARATUS AND FIXING DEVICE WITH FINE SHEET SEPARATION FUNCTION

(75) Inventor: Masamichi Yamada, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 75 days.

(21) Appl. No.: 12/801,237

(22) Filed: May 28, 2010

(65) Prior Publication Data

US 2010/0303523 A1 Dec. 2, 2010

(30) Foreign Application Priority Data

Jun. 2, 2009 (JP) ..... 2009-132892

(51) Int. Cl.
*G03G 15/20* (2006.01)

(52) U.S. Cl. ..... 399/323

(58) Field of Classification Search ..... 399/323, 399/322, 329, 406; 219/216
See application file for complete search history.

(56) References Cited

U.S. PATENT DOCUMENTS

| | | | | |
|---|---|---|---|---|
| 6,088,558 | A | 7/2000 | Yamada | |
| 6,091,926 | A | 7/2000 | Yamada | |
| 6,351,619 | B1 | 2/2002 | Yamada | |
| 6,553,204 | B1 | 4/2003 | Yamada | |
| 6,577,840 | B2 | 6/2003 | Hachisuka | |
| 6,865,363 | B2 | 3/2005 | Hachisuka | |
| 6,925,280 | B2 | 8/2005 | Yamada | |
| 7,228,096 | B2 | 6/2007 | Yamada | |
| 7,359,664 | B2 | 4/2008 | Yamada | |
| 7,751,768 | B2 | 7/2010 | Yamada et al. | |
| 7,890,039 | B2 | 2/2011 | Yamada | |
| 2001/0003562 | A1 | 6/2001 | Hachisuka | |
| 2003/0053830 | A1 | 3/2003 | Hachisuka | |
| 2003/0215270 | A1 | 11/2003 | Yamada | |
| 2005/0276638 | A1 | 12/2005 | Yamada | |
| 2006/0045590 | A1 | 3/2006 | Yamada | |
| 2007/0048035 | A1 * | 3/2007 | Baba et al. | 399/323 |
| 2007/0278735 | A1 * | 12/2007 | Sudo et al. | 271/176 |
| 2008/0080909 | A1 * | 4/2008 | Yamada | 399/323 |
| 2009/0003897 | A1 | 1/2009 | Yamada | |
| 2010/0111579 | A1 * | 5/2010 | Condello et al. | 399/329 |

(Continued)

FOREIGN PATENT DOCUMENTS

JP 2823168 11/1998

(Continued)

OTHER PUBLICATIONS

Abstract of JP 02-208769 published Aug. 20, 1990.

*Primary Examiner* — Walter L Lindsay, Jr.
*Assistant Examiner* — Billy J Lactaoen
(74) *Attorney, Agent, or Firm* — Harness, Dickey & Pierce, P.L.C.

(57) ABSTRACT

A fixing device comprises a fixing roller that fixes a toner image onto a sheet, plural rollers including the fixing roller, and an endless fixing belt driven and wound around the plural rollers. A pressing member is provided to press against the fixing roller via the fixing belt. The pressing member creates a fixing nip on the fixing belt. A slip supporting member is provided to press against the inner surface of the fixing belt at an exit section on a sheet conveyance path downstream of the fixing nip. Plural separation members are provided to separate the sheet ejected from the fixing nip. The plural separation members are arranged with their leading ends being distanced from the exit section.

7 Claims, 14 Drawing Sheets

U.S. PATENT DOCUMENTS

2011/0142469 A1* 6/2011 Nakatsuhara et al. ..... 399/69

FOREIGN PATENT DOCUMENTS

| | | |
|---|---|---|
| JP | 2004-093582 | 3/2004 |
| JP | 2006-011193 | 1/2006 |
| JP | 2006-243471 | 9/2006 |
| JP | 2008-065042 | 3/2008 |
| JP | 2008-083515 | 4/2008 |
| JP | 2008-224833 | 9/2008 |
| JP | 2009-031759 | 2/2009 |
| JP | 2010-079219 | 4/2010 |

* cited by examiner (a)

DETAIL OF SECTION-A (b)

DETAIL OF SECTION-B

IMAGE FORMING APPARATUS AND FIXING DEVICE WITH FINE SHEET SEPARATION FUNCTION

CROSS-REFERENCE TO RELATED APPLICATIONS

This application claims priority under 35 USC §119 to Japanese Patent Application No. 2009-132892, filed on Jun. 2, 2009, the entire contents of which are herein incorporated by reference.

BACKGROUND OF THE INVENTION

1. Field of the Invention

The present invention relates to a fixing device for conveying and at the same time heating a sheet, and in particular, to an image forming apparatus, such as a laser printer, a digital copier, a plain paper facsimile, etc., including the fixing device.

2. Discussion of the Background Art

Conventionally, there is provided a fixing device in an image forming apparatus to fix a toner image visualized by toner onto a printing medium, such as a transfer sheet, etc. In such a fixing device, the toner image is fixed due to melting of the toner when the toner image passes through a nip created between a fixing roller or belt heated and rotated by a prescribed device and a pressure roller or belt pressing against the fixing roller or the like.

Since it consists mainly of resin, the toner is fused at the pressing section and sticks to the fixing roller or the like. Accordingly, various devices have been proposed to suppress such toner sticking, for example, by adding wax to the toner, or by coating releasing agent, such as silicon oil, etc., to the surface of the fixing roller.

Further, a sheet separation mechanism having a separation plate is arranged adjacent to the fixing roller or belt to forcibly separate a sheet winding around the fixing roller or belt due to melting of the toner.

However, since the separation plate slidingly contacts the fixing member, the toner readily accumulates at the contact section, and sometimes drops and contaminates the printing medium. Further, a slide contact mark is put on the fixing member for the same reason, so that its service life decreases and an abnormal image is sometimes formed on the printing medium.

However, due to difficulty in handling the releasing agent in the fixing device, wax is often used instead and is added to the toner.

Thus, the above-mentioned problem becomes aggravated, and accordingly, various inventions related to the rotational member and the separation belt have been proposed.

At the same time, to maintain the same or between separation performance as the separation plate without contacting the rotation fixing member, a gap between a leading end of the separation mechanism and the rotational fixing member needs to be as small as possible, in units on the order of 0.1 mm. That is, the leading end needs to be positioned as closer as possible to the exit of the nip.

However, when arranging the leading end of the separation plate as mentioned above, fine vibration of the surface of the rotational fixing member and an extra ordinarily narrow space located immediately downstream of the nip can cause problems. For example, as described in Japanese Patent Application Laid Open No. 2004-093582, when a non-contact separation plate is employed in a fixing belt system, the gap cannot be precisely adjusted due to floating or rippling of the fixing belt at the exit of the nip.

To suppress the floating or fluctuation of the fixing belt, a driving roller is provided to contact the outer circumference of the fixing belt. Alternatively, a substrate of the fixing belt is thinned or a tension roller is provided inside the fixing belt.

However, even with such countermeasures, the separation plate cannot track fluctuation of the fixing belt because the separation plate does not contact the fixing belt. Further, due to unevenness of manufacturing precision of parts, there is a limit on how finely the gap can be adjusted. More over, even though the fluctuation of the fixing belt and that of the gap can be suppressed in the initial stage of usage, an elastic layer of the fixing roller softens and/or deforms. As a result, the gap fluctuation becomes hardly suppressed as time elapses.

When the elastic layer of the fixing roller softens as the pressure roller contacts the surface of the fixing belt, the pressure roller bites into the fixing belt more than initially, thus increasing the gap. When the tension roller is arranged inside the fixing belt and the elastic layer of the fixing roller softens, the driving roller draws the fixing belt more than initially, and the gap decreases. As a result, in the worst case, the separation plate interferes with and damages the fixing belt.

Further, it is proposed in Japanese Patent Application Laid Open No. 2006-243471 that a separation member is arranged inside a fixing belt as a separation device immediately downstream of the fixing nip to change its separation curvature and improve a separation performance of the fixing belt. However, the separation member is arranged as in Japanese Patent Application Laid Open No. 2004-093582, and accordingly, the gap needs to be additionally adjusted as time elapses.

Further, a thin coat sheet is increasingly demanded in a market recently, and possibly causes the above-mentioned separation problem.

Further, the leading end of the separation plate of such an apparatus cannot accurately track fluctuation of the fixing belt arranged adjacent thereto. As a result, the leading end sometimes damages the surface of the fixing belt or the gap between the leading end of the separation plate and the surface of the rotational fixing member cannot be decreased beyond a prescribed level.

Further, to increase a biting amount of a fixing roller into a pressure roller and accordingly a nip width therebetween for the purpose of maintaining the fixing performance in the narrow space, a sponge member made of foam silicon or the like has come to be employed as an elastic layer of the fixing roller. As a result, although such an arrangement does minimize a warm-up period it also aggravates the above-mentioned problem.

SUMMARY OF THE INVENTION

Accordingly, an object of the present invention is to address and resolve such and other problems and provide a new and novel fixing device. Such a new and novel fixing device comprises a fixing roller that fixes a toner image onto a sheet, plural rollers including the fixing roller, and an endless fixing belt driven and wound around the plural rollers. A pressing member is provided to press against the fixing roller via the fixing belt. The pressing member creates a fixing nip on the fixing belt. A slip supporting member is also provided to press against the inner surface of the fixing belt at an exit section on a sheet conveyance path downstream of the fixing nip. Plural separation members are provided to separate the sheet ejected from the fixing nip. The plural separation members are arranged with their leading ends being distanced from the exit section.

In another aspect of the present invention, a surface of the slip supporting member has a convex shape.

In yet another aspect of the present invention, the slip supporting member has a fluorine resin surface layer.

In yet another aspect of the present invention, the convex shape adjusts an outer circumference curvature of the fixing belt.

In yet another aspect of the present invention, a pressure control device is provided to change a width of the nip by changing pressure applied to the pressing member.

In yet another aspect of the present invention, a sheet separation member is provided to separate the sheet ejected from the nip, and plural spacers each having a leading end engaging with the rotational fixing member are provided to distance the sheet separation member from the rotational fixing member by a prescribed amount. A biasing device is also provided to bias the sheet separation member together with the plural spacers toward the rotational fixing member. Each of leading ends of the plural spacers has a prescribed width and a curvature in a rotational direction of the fixing member. A radius of the curvature is largest at the widthwise center and gradually decreases toward both ends from the widthwise center in the each of the leading ends.

In yet another aspect of the present invention, the plural spacers are arranged at outside of a maximum image region of the rotational fixing member, respectively, and the sheet separation member is arranged within the maximum image region.

In yet another aspect of the present invention, the center of the curvature is substantially coincident with a leading end of the sheet separation member on a cross-section defined perpendicular to a widthwise direction.

In yet another aspect of the present invention, the radius of the curvature is smaller at its widthwise ends than that in the widthwise center by not less than 0.03 mm.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF PREFERRED EMBODIMENTS

Figure 1:
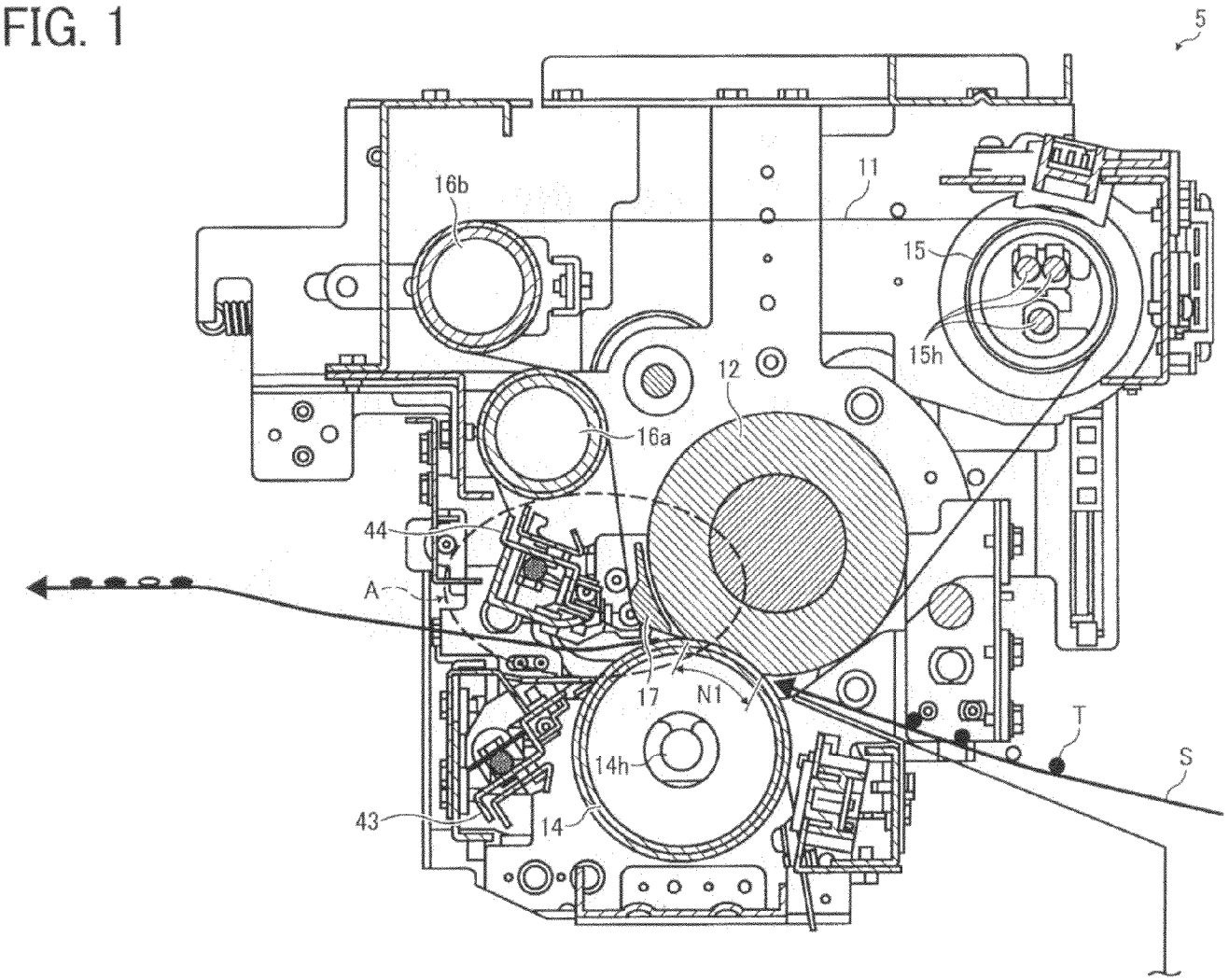
FIG. 1 illustrates an exemplary fixing device according to one embodiment of the present invention.

Referring now to the drawing, wherein like reference numerals designate identical or corresponding parts throughout several views, in particular, in FIG. 1, the fixing device includes a cylindrical fixing roller 12, a heat roller 15, a pair of tension rollers 16*a* and 16*b*, a slide type supporting member 17, a fixing belt 11 wound around these rollers and the member with a prescribed tension, and a pressure roller 14 that freely rotatably presses against the fixing belt 11 and forms a nip section N1 thereon. As shown, the pressure roller 14 presses against the fixing roller 12 via the fixing belt 11. On the exit side of the nip section N1 (i.e., a sheet ejection side), there are provided a separation device 43 that includes a separation member (e.g. a plate), a leading end section of which is arranged adjacent to the pressure roller 14, for preventing a sheet from winding therearound, and a separation device 44 that includes a separation member (e.g. a plate), a leading end section of which is arranged adjacent to the fixing belt 11, for preventing a sheet from winding therearound.

The fixing belt 11 is endless and fixes not fixed toner T carried on a sheet (e.g. a printing medium). The fixing belt 11 includes a three-layer structure of a substrate made of such as nickel, stainless, polyimide, etc., an elastic layer made of such as silicon layer, and a releasing layer overlying the elastic layer. For example, the substrate is highly heat resistant having small heat expansion performance, but relatively large strength. The substrate is made of polyimide resin having an internal diameter of 150 mm and a thickness of about 90 micrometer. The elastic layer includes a silicon layer having a thickness of 200 micrometer. As a releasing layer of the outmost layer, a tube made of fluorine resin, such as PFA, etc., having excellent releasing performance is wrapped or coated having a thickness of 20 micrometer.

The fixing roller 12 includes a substrata roller and a hollow cylindrical heat resistant elastic layer made of such as silicon rubber (e.g. a solid type), a silicon sponge (e.g. a foam silicon rubber having a thickness of 14 mm), etc., overlying the substrata roller, thereby totally having an outer diameter of 60 mm.

The tension rollers 16*a* and 16*b* are arranged between the slip supporting body 17 and the heat roller 15 to support the fixing belt 11 and provides a prescribed tension to the fixing belt 11 using a mechanism of a spring. The tension rollers 16*a* and 16*b* each provides spring force of 9.8N, and totally provide 19.6N at both ends in the fixing device 5.

The heat roller 15 has a hollow cylindrical shape and is made of aluminum or an iron having an outer diameter of 35 mm with a thickness of about 0.6 mm. Further, a heat source having a heater 15*h*, such as a halogen heater, etc., is installed in the heating roller 15 for heating the fixing belt 11. The heat source is arranged other than the nip section N1 not to press against the pressure roller 14 arranged inside the fixing belt 11. Such a heat source can include an induction heating structure. Further, a temperature detection sensor, not shown, is provided to detect temperature of a region where the fixing belt 11 contacts the heating roller 15.

The slip supporting body 17 is arranged inside the fixing belt 11 between the fixing roller 12 arranged on the exit side of the nip section N1 and the fixing belt 11. The slip supporting body 17 sliding contacts and supports the inner surface of the fixing belt 11, so that a position of the fixing belt 11 is constant at the exit of the nip section N1.

Figure 2:
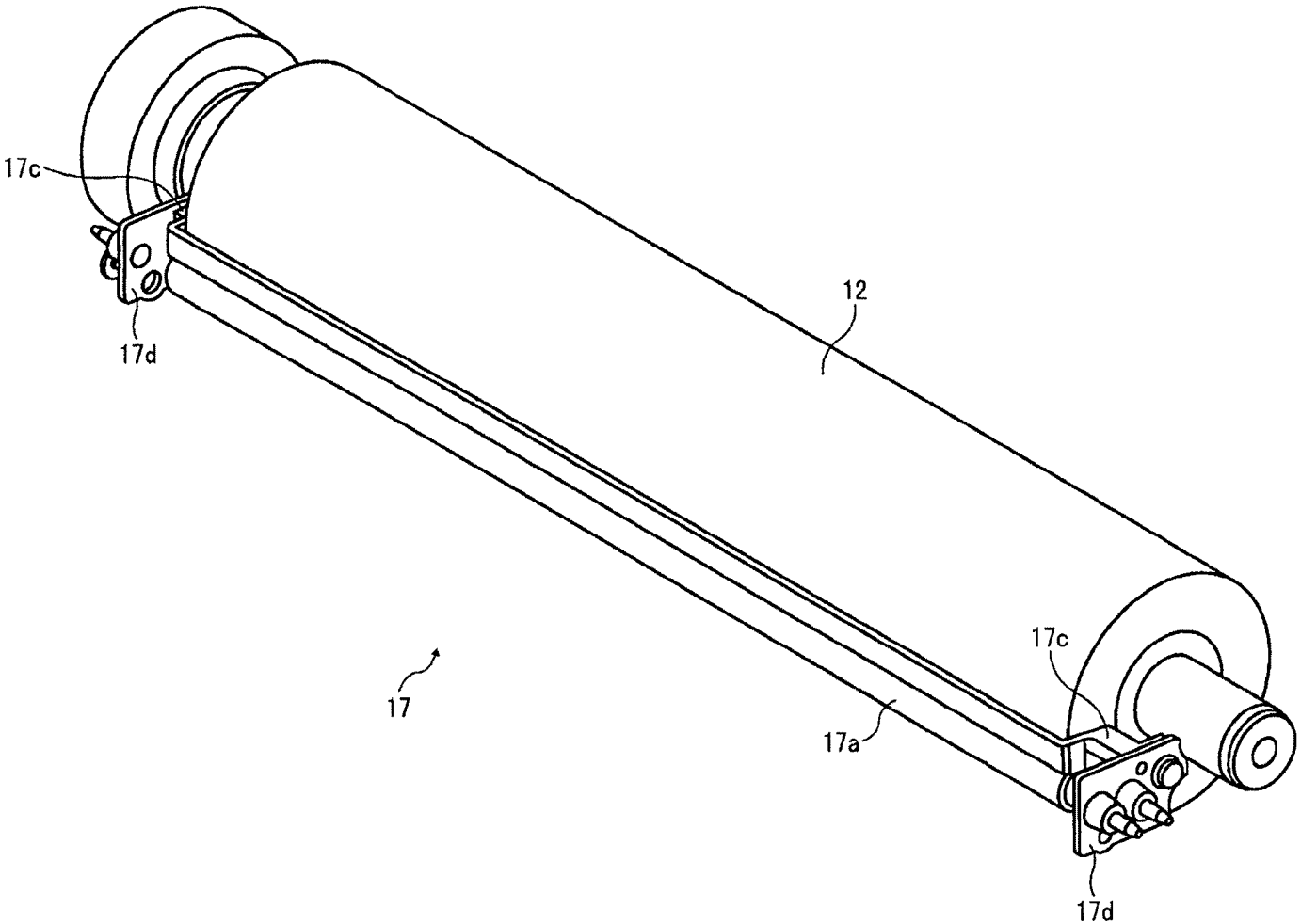
FIG. 2 illustrates an exemplary slide type supporting member employed in various embodiments of the present invention.

Now, an exemplary slip supporting body 17 is described with reference to FIG. 2. The slip supporting body 17 is arranged adjacent to the fixing roller 12 on the exit side of the nip section N1 thereof, and includes a plate like slip supporting member section 17*a* that extends in a widthwise direction of the fixing belt 11, and a linkage member 17*c* integral with both ends of the slip supporting member section 17*a*, and a supporting member 17*d* linked with the linkage member 17*c* and secured to a frame of the fixing device.

The slip supporting member section 17*a* includes a surface that contacts an inner surface of the fixing belt 11 while curving and protruding toward the contact. The slip supporting member section 17*a* is preferably made of metal, such as aluminum, etc., harder than a heat resistant elastic layer of the fixing roller 12. Every shape can be employed for the slip supporting member section 17*a* as far as it can internally contact the fixing belt 11 while keeping the position of the fixing belt 11 at the exit of the nip section N1 beside a plate like one. Specifically, a convex slip supporting member section 17*a* can be employed. Further, a small diameter roller can be employed.

An exemplary exit of a nip section N1 and its surroundings of the fixing device of FIG. 1 are now described with reference to FIGS. 3A and 3B. As shown, FIGS. 3A and 3B omit the strike member to be illustrated at a front side of the drawing. As shown, at the exit of the nip section N1, the fixing belt 11 is supported protruding at a prescribed position while contacting the slip supporting member section 17*a* along the curved surface thereof. The contact section of the fixing belt 11 contacting the slip supporting member section 17*a* does not contact the pressure roller 14. At this moment, since the slip supporting member section 17*a* is supported by the frame of the fixing device 5, the fixing belt 11 can be held at a prescribed position of the exit of the nip section N1 regardless of a change of a width of the nip section N1 when the pressing device is adjusted as mentioned later in detail.

Thus, since the fixing belt 11 and the separation device 44 maintain a prescribed positional relation at the exit, a fine separation performance capable of separating the printing medium from the fixing belt 11 can be obtained.

Further, a system in which a small diameter separation roller is arranged in a fixing device between a fixing roller 12 and a fixing belt 11 on the exit side of the nip section N1 has been proposed. In such a configuration, a nip width is obtained by pressing the pressure roller 14 against both of the fixing roller 12 and the separation roller via the fixing belt 11. Thus, a curvature radius at the nip section exit is determined by a small curvature of the separation roller, whereby a separation performance can be improved. However, a nip pressure unstable region (e.g. a middle nip region) appears between the fixing roller 12 and the separation roller, and possibly causes image deterioration. Then, since this embodiment of the present invention omits the separation roller and the middle nip region, image deterioration can be suppressed.

Further, a fluorine resin layer is preferably formed on the surface of the slip supporting member section 17*a* contacting the inner surface of the fixing belt 11. Thus, slide resistance decreases between the inner surface of the fixing belt 11 and the slip supporting member section 17*a*, and accordingly, abrasion therebetween is suppressed and their lives can be prolonged.

Further, the slip supporting member section 17*a* preferably includes a convex portion 17*b* that extrudes the fixing belt 11 just downstream of the exit of the nip section N1 from inside to adjust an outer circumference curvature thereof. The just downstream of the exit corresponds to a region between a contact point (G) where strike members 44*b*, mentioned later, arranged on both ends of the separation device 44 outside the maximum image region via the fixing belt 11 of the slip supporting member section 17*a*. Thus, at the slightly up stream of the leading end section 44*cc* of the separation device 44, the sheet is separated from the fixing belt 11 due to curvature separation of the convex section 17*b*. In particular, since the sheet is separated from the leading end margin thereof, the leading end extraordinarily rarely sinks into a gap between the leading end 44cc of the separation device 44 and the fixing belt 11 when it is conveyed and arrives at the leading end 44*cc* thereof. Thus, separation performance can be improved.

Back to FIG. 1, the pressure roller 14 is cylindrical and includes a core metal made of such as aluminum, iron, etc., and a heat resistant elastic layer made of such as silicon rubber (e.g. a solid type), silicon sponge (foam silicon rubber), etc. For example, the pressure roller 14 has an outer diameter of about 50 mm and includes a steel hollow core metal having a thickness of about 1 mm, a silicon rubber having a thickness of 1.5 mmm overlaying the core metal, and a tube made of PFA as the outermost layer coated thereonto. The pressure roller 14 includes a heater 14*h* controlled to turn on and off based on temperature of the pressure roller 14 detected by a temperature detection sensor 72 (see, FIG. 4). Thus, heat is prevented from being absorbed by the pressure roller 14 from the sheet when the sheet passes through the nip section N1. Further, a web-cleaning unit, not shown, is provided on the outer circumference of the pressure roller 14 to remove offset toner and paper dust or the like.

Figure 4:
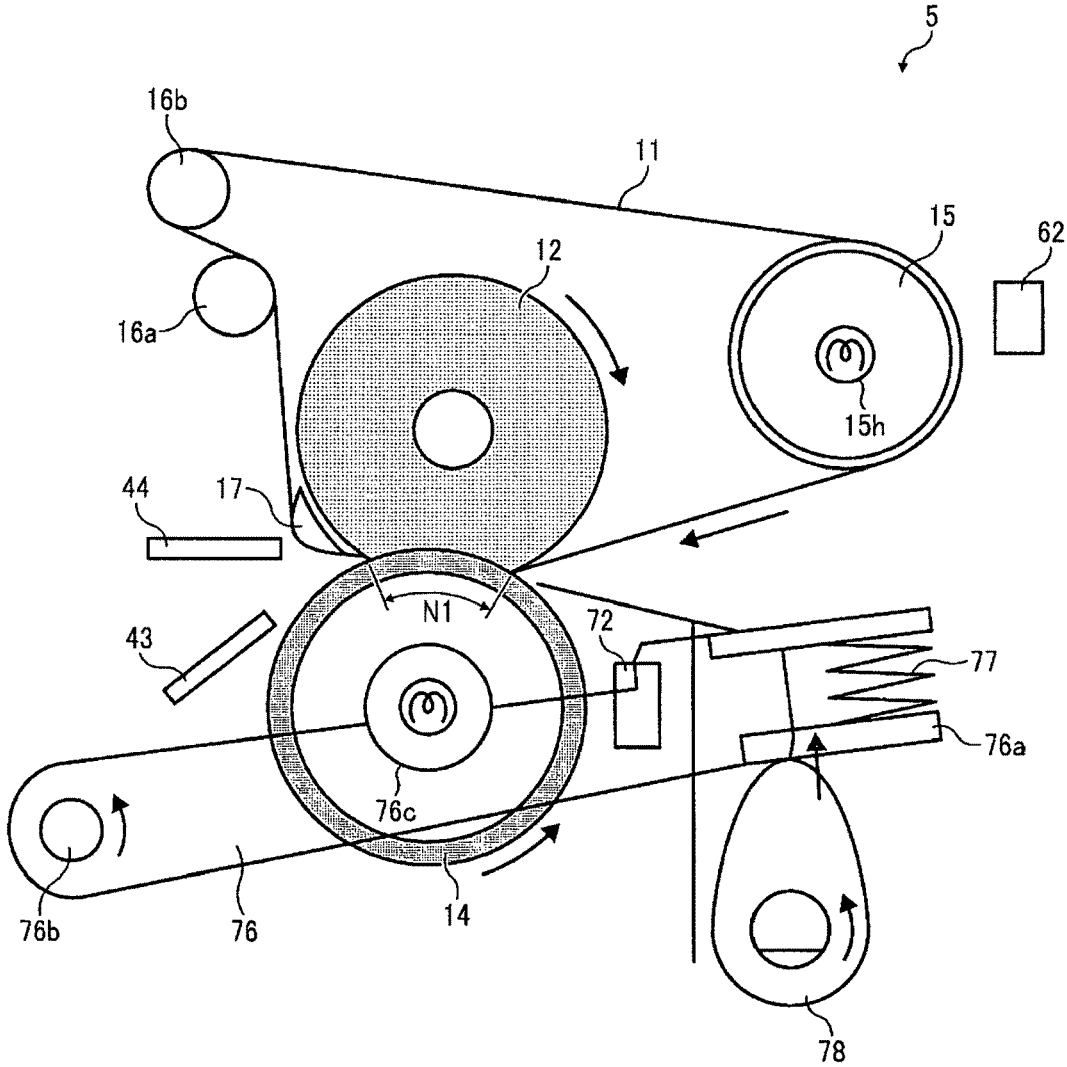
FIG. 4 illustrates an exemplary pressing device provided in the fixing device of FIG. 1.

Further, as shown in FIG. 4, the pressure roller 14 includes a pressing device having a pressing lever 76, a spring 77, a pressing intermediate member 76*a*, and a cam 78. Thus, the pressing device controls the pressure roller 14 to press against the fixing roller 12 to make a nip section N1 via the fixing belt 11 or is separated therefrom to open the nip section N1. Further, a width of the nip section N1 is variable in accordance with a type of sheets or modes (e.g. brilliance applying or not applying modes) to provide various sheet-passing conditions.

When the pressure roller 14 is brought into a pressing condition by the pressing device, the cam 78 is rotated by an external driving force by a prescribed angle in a direction shown by an arrow in FIG. 4. The cam 78 thus lifts the pressing intermediate member 76*a* in the arrow showing direction. Then, the spring 77 secured to the pressing intermediate member 76*a* lifts the pressing lever 76 via its end with a prescribed pressure. Then, the pressing lever 76 swings counterclockwise in FIG. 4 around a supporting shaft 76*b* as a swinging center. Then, the pressing section 76*c* arranged at middle between the end of the pressing lever 76 on the spring side 77 and the supporting shaft 76*b* contacts a shaft of the pressure roller 14 and attempts to depress it toward the fixing roller 12.

Finally, the pressure roller 14 presses against the fixing roller 12 via the fixing belt 11 with a prescribed pressure to provide a nip section N1 for fixing use. The spring 77 can be omitted as the pressing device. Instead, the cam 78 can directly lift up the end of the pressing lever 76.

At this moment, the pressure roller 14 bites into the fixing roller 12 by a prescribed depth (2 to 4 mm) via the fixing belt 11. Thus, the nip section N1 comes to have a prescribed width.

In the fixing device 5, the pressing device changes a pressing condition of the pressure roller 14 and changes a contact condition between the fixing roller 12 and the pressure roller 14 inside the fixing belt 11, whereby the nip width is switched in plural steps. This is provided as a countermeasure to suppress a change of brilliance in accordance with a thickness of a sheet when the nip width is constant in an image brilliance mode, or to suppress an increase of the brilliance when a thin sheet is used in a non-image brilliance mode in which brilliance is not intentionally applied in the fixing device 5. Specifically, in accordance with the mode and condition of the thickness and the type of the sheet or the like, the pressing device can adjust the nip width and accordingly the brilliance level.

For example, when a thick sheet having a basic weight of 124 to 300 g/m$^2$ is used, the cam 78 is adjusted and the nip width is increased. When a sheet having a basic weight less than that of a plain paper is used, calorie is excessively provided to the sheet from the nip section N1 if not controlled, and as a result, a brilliance of an image increases more than intended, and is to be suppressed. Thus, the cam 78 needs to be adjusted and the nip width needs to decrease so as to suppress the brilliance. Thus, even the sheet having less basic weight than the plain paper and readily receiving the excessive calorie is used in the non-brilliance mode, image brilliance can be maintained as the thick sheet by adjusting the nip width.

Further, in the brilliance mode, by adjusting the cam 78 and accordingly the nip width of the nip section N1 in the fixing device in accordance with the thickness of the sheet, the brilliance level of an post fixing image (i.e., a fixing toner) is set to be 10 to 30%, preferably 20 to 30%, more preferably not less than 25%, such as from 25 to 30%, etc. Thus, image brilliance can be ultimately made constant in accordance with a brilliance level of the image on the sheet.

As a pressing condition, a load from 15 to 30N/cm2 is applied in the nip section N1. When a gross coat sheet is used (in a brilliance mode), a nip width is set to be 20 mm. When the plain paper is used (in a non-brilliance mode), the nip width is set to be 15 mm. As a result, a total nipping time period is not less than 50 mili second in the nip section N1. However, by adjusting and decreasing the period, fixing to the sheet including the thick sheet having the basic weight of about 300 g/m2 can be sufficiently executed.

Thus, a desired brilliance is credibly improved in the both modes. Further, with such a broad nip section, fixing for various types of sheets can be finely executed while maintaining high speed and productivity.

An exemplary separation device 44 is described with reference to FIG. 5. As shown, the separation device 44 includes plural separation plates 44*c* (e.g. seven pieces) arranged in a widthwise direction of the fixing belt 11 secured to a supporting frame 44*d*. The plural separation plates 44*c* are arranged not to contact the fixing belt 11 at a position supported by the slip supporting body 17. The numbers of the separation plates 44*c* can be one. However, the plural separation plates 44*c* can be advantageous, because gaps can be independently adjusted and thereby separation performance can be improved.

Figure 6:
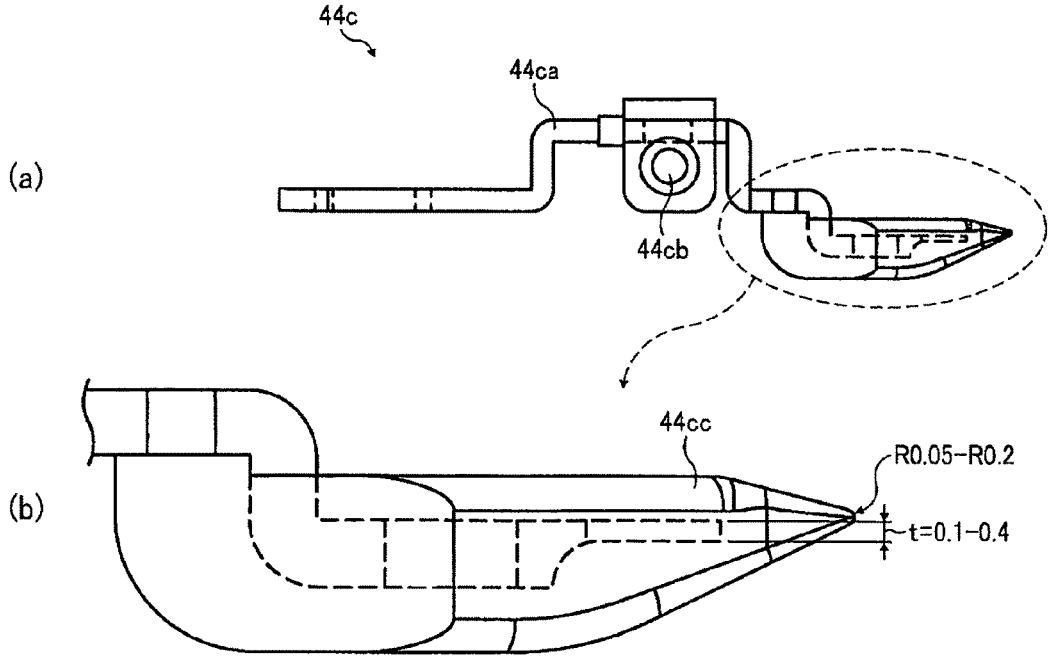
FIG. 6 illustrates an exemplary separation plate used in the separation device of FIG. 5.

As shown in FIG. 6, the separation plate 44*c* includes a plate like substrate 44*ca* having a supporting shaft 44*cb* and a leading end section 44*cc* integrally produced by ejection insert molding with the substrate 44*ca* made of fluorine resin softer than the substrate 44*ca*. Specifically, the separation plate 44*c* includes the substrate 44*ca*, a body section having a fluorine resin layer at least arranged on a surface facing a sheet ejection path (i.e., a lower portion of the separation plate 44*c*), and a leading end section 44*cc* only made of fluorine resin having a width in the widthwise direction of the fixing belt 11 having a sharp leading end section on its cross section. Specifically, the body section includes rigidity relying on the substrate 44*ca* and does not deform and keeps its shape even collided by a jam sheet S. Further, since the substrate 44*ca* extends up to almost the leading end section of the separation plate 44*c*, a gap between the separation plate 44*c* and the fixing belt 11 keeps precision due to deformation caused by heat. Since the leading end section 44*cc* is only made of fluorine resin, it does not damage the fixing belt 11 even contacting thereto. Further, since the body section on the sheet ejection path side and the leading end section 44*cc* are made of fluorine resin, toner releasability is excellent, and the toner does not contaminate the separation plate 44*c*.

Since the substrate 44*ca* and the leading end section 44*cc* are integrally produced by insert molding, the supporting shaft of the substrate 44*ca* and the leading end section 44*cc* can be molded with fine positional precision. Thus, a separation performance is equally excellent to a separation device molded by the same material. A thickness of the leading end section of the substrate 44*ca* is made thinner to be 0.1 to 0.4 mm, and is thus readily molded sharply.

Further, the separation device 44 includes plural strike members 44*b* capable of striking both widthwise side ends of the fixing belt 11 at widthwise both ends of the supporting frame 44*d*. The strike members 44*b* are arranged with reference to the frame of the fixing device 5 via the supporting frame 44*d* and strike the widthwise both ends of the fixing belt 11 by a prescribed pressure caused by a spring or the like. As a result, basic intervals between the plural separation plates 44*c* and the fixing belt 11 can be determined. Further, the strike members 44*b* are arranged outside the maximum image region of the fixing device 5 or the maximum sheet passage width (i.e., a sheet conveyance region), they do not affect an image on the sheet S or conveyance thereof.

Figure 7:
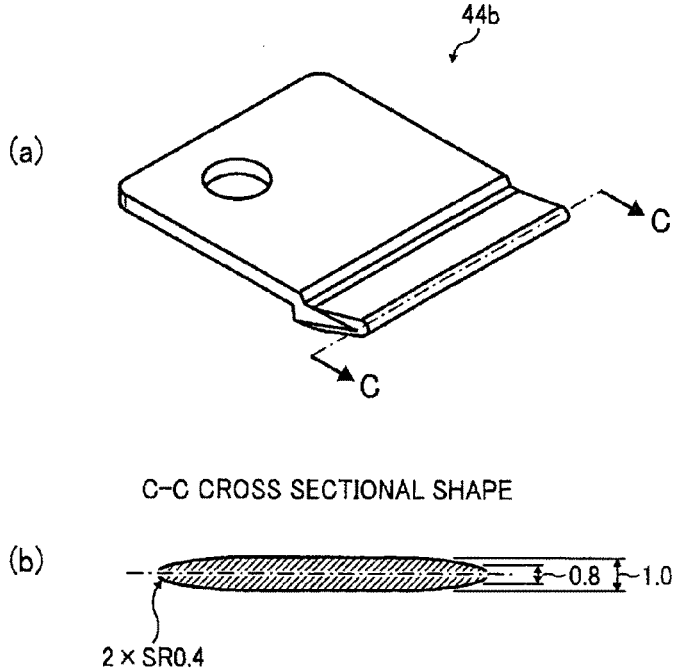
FIG. 7 illustrates an exemplary strike member used in the separation device of FIG. 5.

Now, an exemplary strike member 44*b* is described with reference to FIG. 7. As shown in FIG. 7A, the strike member 44*b* is plate like and includes a side with a leading end section having a curvature in a fixing belt moving direction and striking the fixing belt 11. Since the strike member 44*b* strikes a section of the elastic fixing belt 11 that obliquely travels, the leading end section and a portion of the upper surface thereof come to contact the fixing belt 11. Thus, in a conventional strike member 44*b*, stress from the fixing belt 11 concentrates on widthwise both ends of the strike member 44*b* at the contact therebetween. As a result, a scuffing mark or cut readily is produced at the contact. Then, the striking leading end section of the strike member 44*b* is a drum shape and has a cross section that passes through a center core in a shaft sliding direction in relation to the fixing belt 11 (e.g. at a cross section at a line C-C in FIG. 7B) in which a radius gradually decreases from the maximum level (e.g. R=0.5 mm) at the center. Each of the curvature radiuses of the widthwise both ends of the leading end section of the strike member 44*b* is preferably less than that of the center by not less than 0.03 mm. As a result, the stress concentration onto the edge of the contact where the strike member 44*b* sliding contacts the fixing belt 11 can be suppressed, and accordingly, the scuffing mark or cut readily can substantially be avoided.

Now, exemplary conditions of the separation plate 44*c* mounted and dismounted from the supporting frame 44*d* are described with reference to FIGS. 8A and 8B, respectively. As shown, a separation plate holder 44*e* made of a frame state plate spring is screwed into the supporting frame 44*d* to hold the separation plate 44*c*. Plural bosses formed on both ends of the supporting shaft 44*cb* fit into boss holes formed on the separation plate holder 44*e*, respectively. Thus, the separation plate 44*c* is swingable around the supporting shaft 44*cd* in relation to the supporting frame 44*d*. An adjusting screw 44*k* is inserted into a hole formed on an end opposite to the leading end section 44*cc* of the substrate 44*ca* via a compression spring 44*s* and screwed into the supporting frame 44*d*. Thus, the leading end section 44*cc* swings around the supporting shaft 44*cd* and is adjustable in relation to the supporting frame 44*d* and the strike member 44*b* in accordance with a level of screwing of the adjusting screw 44*k* into the supporting frame 44*d*.

Now, an exemplary relation between a slip supporting body 17 and the separation device 44 is described. As mentioned earlier, the slip supporting member section 17*a* of the slip supporting body 17 contacts the inner surface of the fixing belt 11 at the exit of the nip section N1 and projects the fixing belt 11 along its curvature and maintains the same at a prescribed position.

The separation device 44 is supported such that rotational fulcrums 44*a* in a boss state are arrange at both ends of the supporting frame 44*d* and are inserted into boss holes formed on two rotational levers 44*f*, respectively. Each of the rotational levers 44*f* is an L-shape formed with reference to the frame of the fixing device 5. The arm section supports protrusions 44*a*' on the side of the fixing belt 11 of the rotational fulcrum 44*a* at widthwise both ends of the supporting frame 44*d*. One end of the tension spring 44*g* is attached and draws the other one of the arm sections of the rotational levers 44*f*. Accordingly, due to function of the tension spring 44*g*, the rotational lever 44*f* and the separation device 44 swing around the rotational fulcrum 44*a* in a direction such that the leading end section 44*cc* of the separation plate 44*c* is biased toward the fixing belt 11 counterclockwise in FIG. 3.

At this moment, the strike members 44*b* of the both ends of the separation device 44 contact the contact points G of the fixing belt 11 formed on a region of the fixing belt 11 projected by the slip supporting body 17.

The leading end section 44*cc* is arranged substantially on the center of the curvature of the leading end section of the strike member 44*b* on a cross section perpendicular to a shaft direction. Thus, the leading end section of the leading end section 44*cc* slightly deviates from the leading end position of the strike member 44*b* apart from the fixing belt 11 on the supporting frame 44*d*. Accordingly, as shown in FIG. 3B, by contacting the strike member 44*b* to the fixing belt 11, non-contact positional relation between the strike member 44*b* to the fixing belt 11 are provided with a prescribed gap. Whereas if the position of the leading end section 44*cc* is separately determined from the other place, unevenness of component parts or positional fixing belt directly causes unevenness of gaps of the separation plate, and accordingly, a wide separation plate gap is necessarily provided to resolve the unevenness. However, a thin coat sheet is increasingly demanded recently, and thus, a sheet type incapable of separation undesirably increases.

Figure 3:
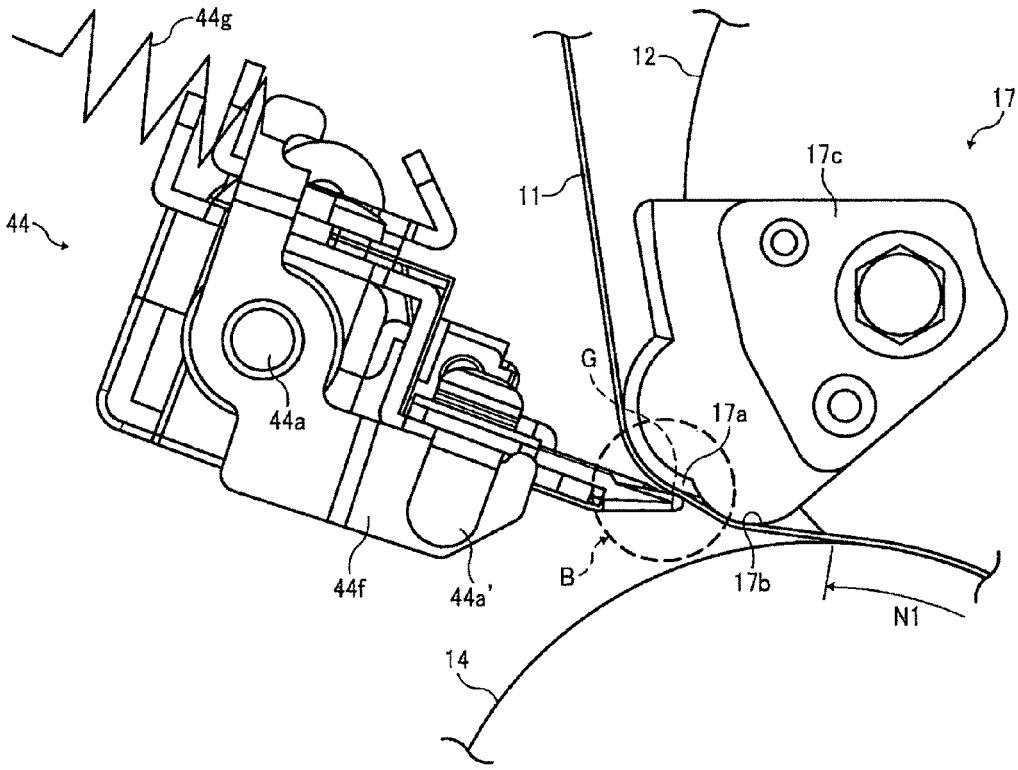
FIG. 3 illustrates an exemplary exit of a nip section and its surroundings of the fixing device of FIG. 1.
Figure 3:
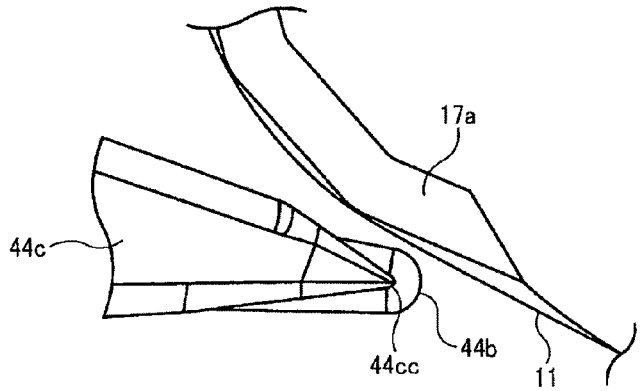

Further, with the configuration of FIG. 3, the leading end section 44*cc* comes to follow the positional variation of the fixing belt 11. Further, material of the slip supporting member section 17*a* is made of aluminum or the like and is thus much harder and has less heat expansion in comparison with foam silicon of the heat resistant elastic layer of the fixing roller 12. Thus, the gap between the separation plate 44*c* and the fixing belt 11 initially set can be maintained to be substantially the same level capable of almost avoiding changes even as time elapses.

As a result, at the exit of the nip section N1, the gap between the fixing belt 11 is held at the prescribed position by the slip supporting body 17 and the leading end section 44*cc* of the separation plate 44*c* can be precisely maintained to be a small level and be able to obtain the fine separation performance. Thus, a range of the sheets capable of separation can be extended. Further, the leading end section 44*cc* can be suppressed to contact and damage the fixing belt 11.

Now, an exemplary arrangement of the separation device 44 is described. As shown, at the contact point G between the curvature shape section of the strike member 44*b* and the layer of the fixing belt 11 supported by the curvature of the slip supporting member section 17*a*, there is provided the separation device 44 such that the rotational fulcrum 44*a* positions at a region surrounded by a tangential line A drawn from the layer curvature of the fixing belt 11 to downstream of the sheet conveyance direction and a straight line B drawn from the contact point G at an angle of 30 degree.

Figure 10:
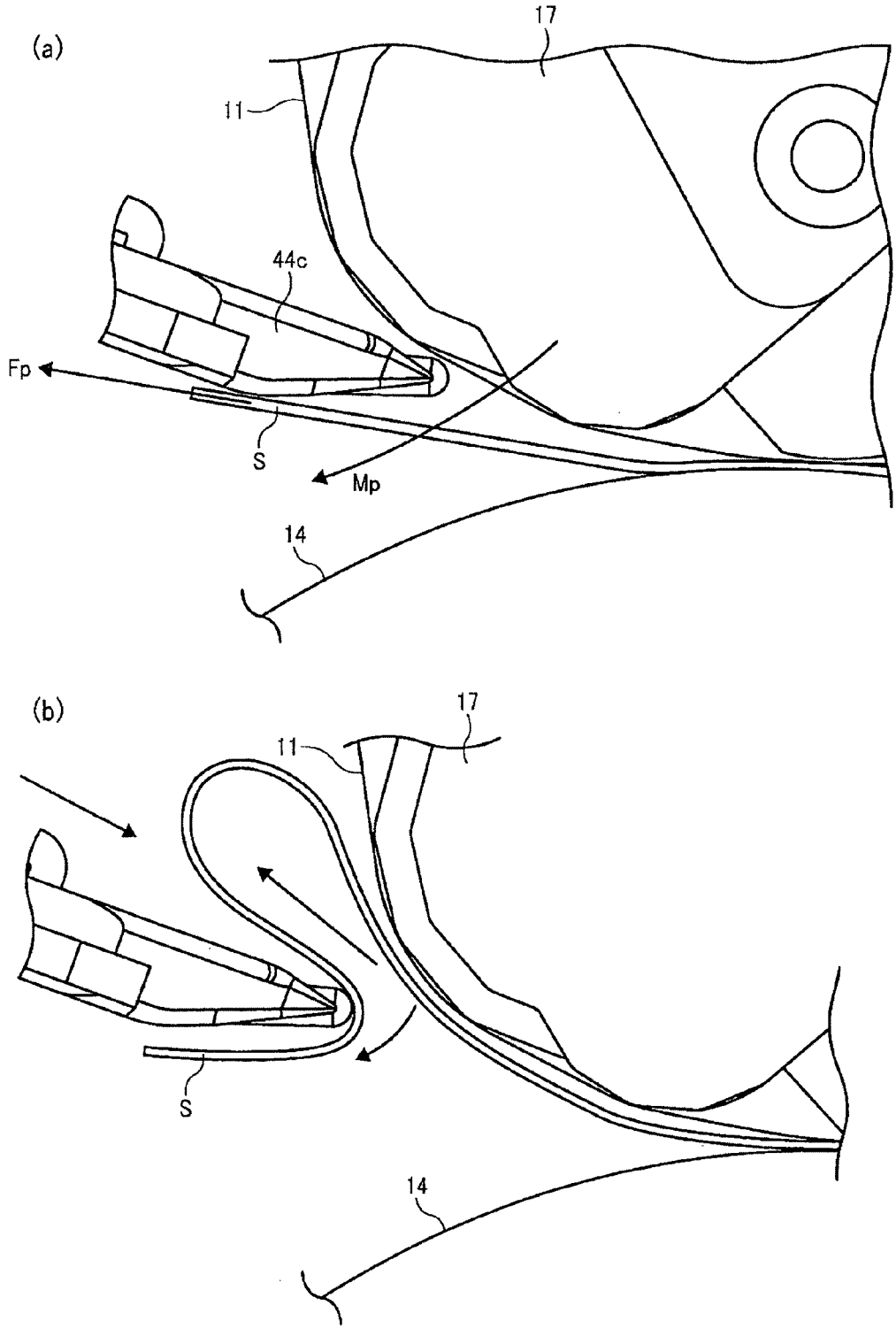
FIG. 10 illustrates influence of an arrangement position of the separation device at the exit of the nip section to sheet jam.

Specifically, if the rotational fulcrum 44*a* positions on the side of the fixing belt 11 of the tangential line A, moment Mp caused by a shearing force Fp created by sliding contact between the sheet S and the separation plate 44*c* increases as shown in FIG. 10A. As a result, the separation device 44 swings around the fulcrum 44*a* such that the gap between the leading end section 44*cc* and the fixing belt 11 increases, and accordingly, the sheet easily enters the gap and causes jam as shown in FIG. 10B.

Figure 11:
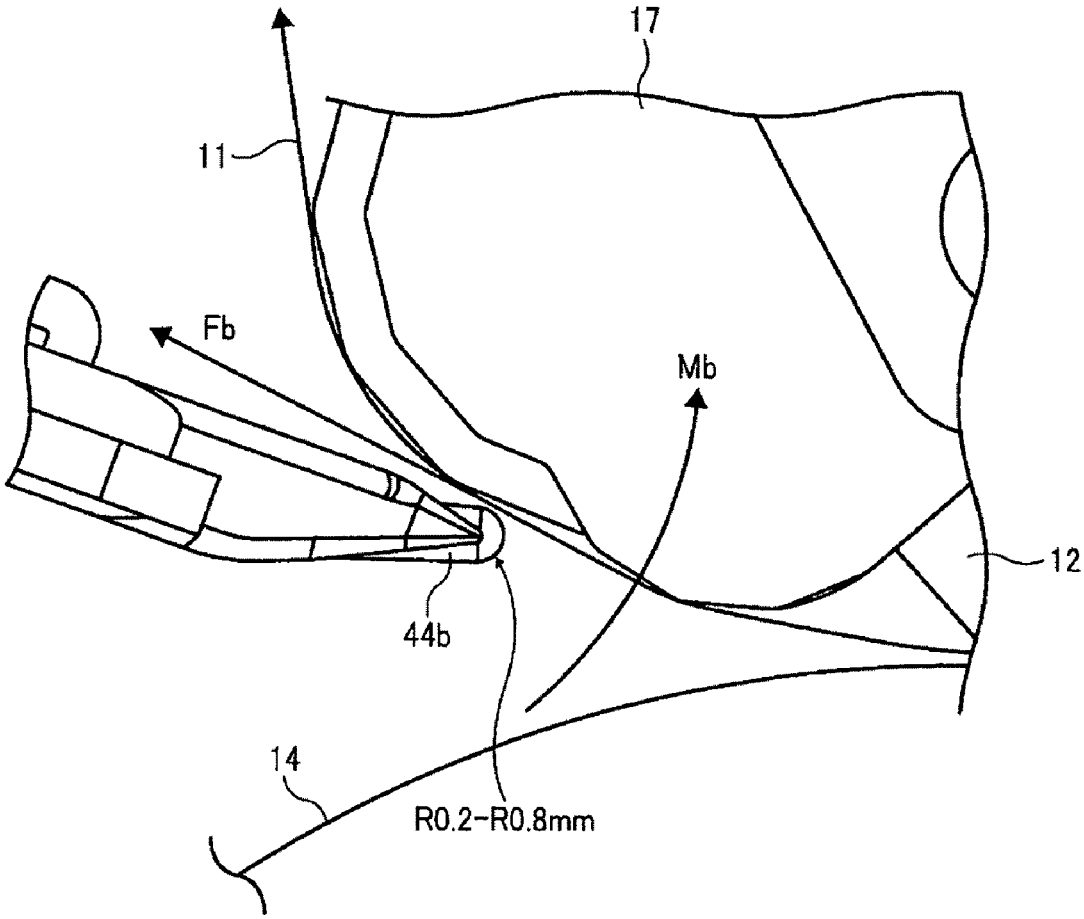
FIG. 11 illustrates influence of an arrangement position of the separation device at the exit of the nip section to the fixing belt.

In contrast, when the rotational fulcrum 44*a* positions on the opposite side of the fixing belt 11 of the tangential line B as shown in FIG. 11, moment Mb is caused by a shearing force Fb created at the contact point G between the strike member 44*b* and the fixing belt 11 and increases. As a result, due to a force of biting of the strike member 44*b* into the fixing belt 11, the fixing belt 11 can be highly probably damaged.

Figure 9:
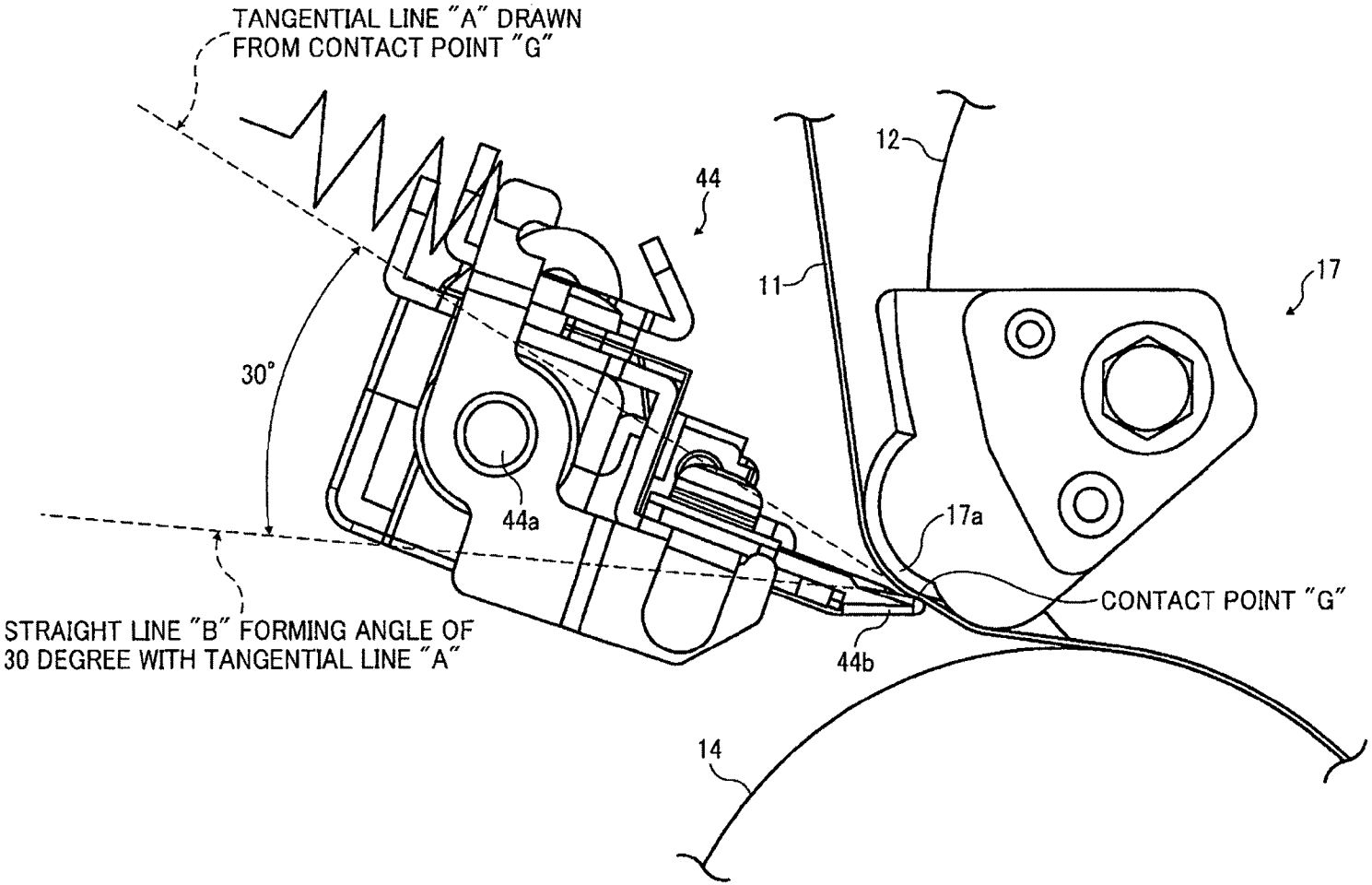
FIG. 9 illustrates an exemplary arrangement of the separation device at the exit of the nip section.

Then, according to one embodiment of the present invention, as shown in FIG. 9, such a problem can be prevented by arranging the rotational fulcrum 44*a* at the region surrounded by the tangential line A and the straight line B.

Further, if the rotational fulcrum 44*a* positions on the opposite side of the fixing belt 11 of the tangential line A, the strike member 44*b* having the curvature shape at its both ends outside the maximum image region come to have a moment Mb in a biting direction into the fixing belt 11 due to the shearing force Fb created at the contact point G contacting the fixing belt 11.

To decrease the moment Mb, it is also effective to decrease the shearing force Fb at the contact point G beside the arrangement of the rotational fulcrum 44*a* at the region surrounded by the tangential line A and the straight line B It is effective to increase the radius R of curvature shape section of the strike member 44*b* to decrease the shearing force Fb. However, if it is excessively large, the curvature radius of the strike member 44*b* is excessive and is hardly arranged adjacent to the nip section N1 at the very narrow exit of the nip section N1.

Then, as shown in FIG. 11, the curvature radius is preferably 0.2 to 0.8 mm. As a result, the shearing force Fb can be minimized, and the strike member 44*b* and the leading end section 44*cc* can be arranged very close to the nip section N1.

Further, the minimum value of a leading end margin on the sheet S is generally from 2 to 5 mm in view of a specification of an image forming apparatus, and sheets, such as a thin coated paper, etc., unfavorable to separation are demanded to employ. To handle such sheets keeping prescribed separation quality, a gap between the leading end section 44*cc* and the fixing belt 11 needs to be adjusted to be 0.1 to 0.6 mm.

Then, according to one embodiment of the present invention, to adjust the gap, the maximum radius is not more than 0.8 mm at the center of the curvature shape section of the strike member 44*b*, while the curvature center of the strike member 44*b* is arranged to almost coincide with the leading end section 44*cc* of the separation plate 44*c* in the shaft direction. However, to prevent abnormal image and wrinkling, a normal or reverse crown shape is sometimes employed in a sliding surface of the slip supporting member section 17*a* slide contacting the fixing belt 11 in an axial direction (i.e., a widthwise direction of the fixing belt). As a result, it can cause the gap between the leading end section 44*cc* and the fixing belt 11 to vary in the axial direction.

Further, when the supporting frame 44*d* is slightly bent or deformed, or the fixing belt 11 and slip supporting body 17 cause deviation or deformation, the gap between the leading end section 44*cc* and the fixing belt 11 sometimes varies.

Figure 8:
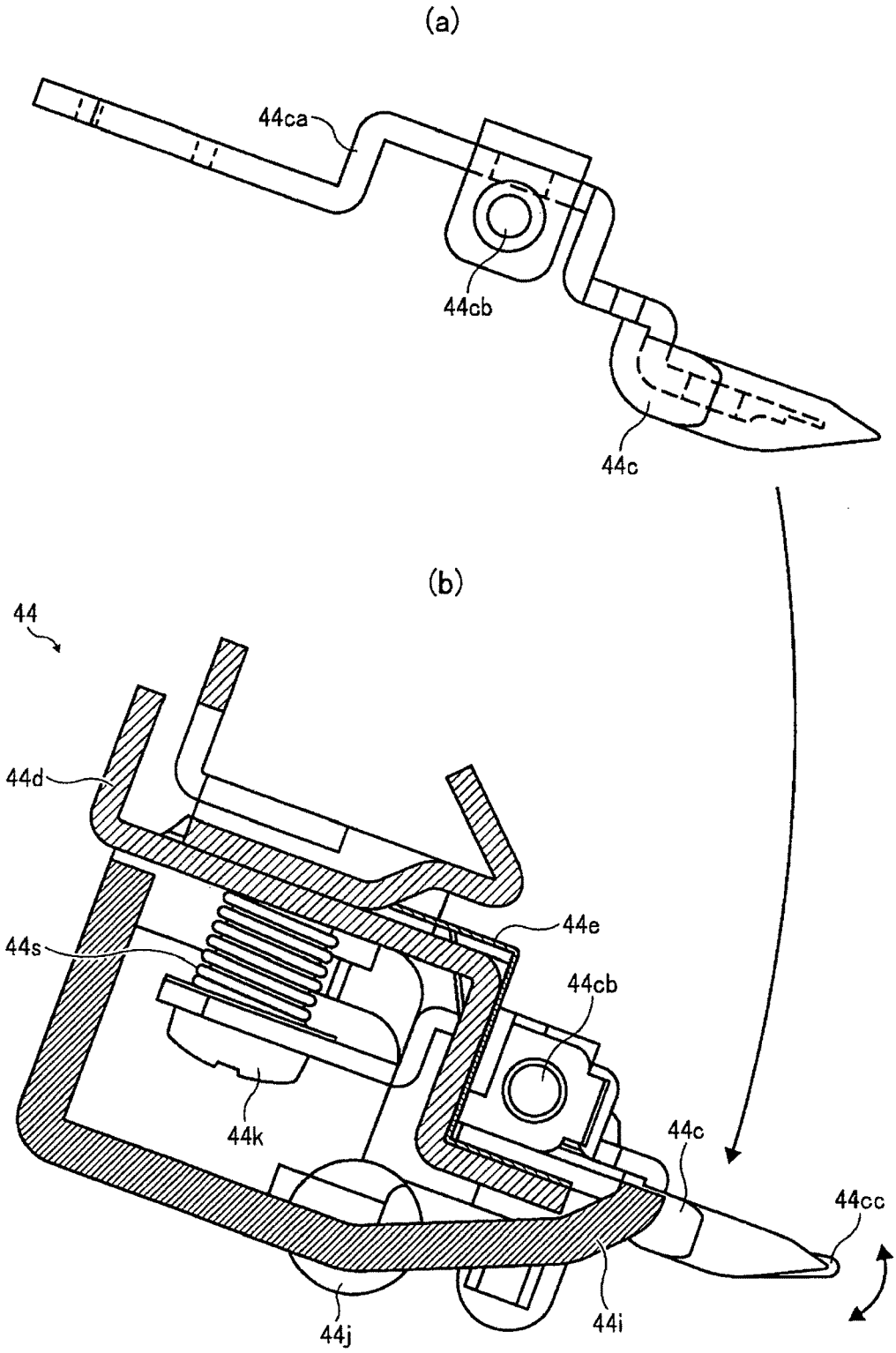
FIG. 8 illustrates an exemplary condition of the separation plate of FIG. 6 being attached to a supporting frame.

Then, according to one embodiment of the present invention, as shown in FIG. 8., the adjusting screws 44*k* are enabled to finely adjust positions of the leading end sections 44*cc* in relation to the strike member 44*b* with reference to the supporting frame 44*d* per separation plate 44*c*. Thus, the gaps between the leading end sections 44*cc* and the fixing belt 11 can entirely be adjusted to have 0.1 to 0.6 mm. Thus, even no contact type separation device 44 can achieve the same or more excellent separation performance than the contact type.

When the fixing device 5 is driven, as shown in FIG. 1, a drive motor provided therein rotates the pressure roller 14 counterclockwise in the drawing. Further, another driving motor rotates the fixing roller 12 clockwise in the drawing, and the fixing belt 11 rotates in a sheet S ejection direction in FIG. 1 with a prescribed appropriate tension. The pressure roller 14 is controlled as a main drive roller for the fixing device 5 to be driven by a drive mechanism, such as motor, etc., and its outer circumference speed serves as a conveyance speed of the sheet in the fixing device 5 (herein after referred to as a sheet conveyance speed or a conveyance speed). In this embodiment, the pressure roller 14 has a thinner elastic layer than the fixing roller 12. Accordingly, due to less variation of surface temperature, a change of an outer diameter of the pressure roller 14 decreases, and is thus preferable as the main drive roller.

When fixing, the fixing belt 11 is heated by the heater 15*h* in the driven rotated heating roller 15 to a prescribed level such as toner appropriate fusing level, etc., and is detected by the temperature sensor 62.

Subsequently, the sheet S with a not fixed toner T is passed through the nip section N1 from right to left in the drawing, so that not fixed toner T is fused and fixed there onto by heat and pressure in a fixing process.

The sheet S is then separated from the fixing belt 11 by the separation device 44 on the ejection side of the nip section N1, or is separated from the pressure roller 14 by the separation device 43, and is ejected.

The sheet S is then guided by a guide plate 45 arranged at a separation nip section exit as mentioned later in detail, and is led to the conveyance path to be appropriately conveyed. When a first page of the sheet S carries a solid image and a second page thereof has a few toner images of almost blank in a duplex printing, the sheet readily winds up around the pressure roller 14. However, in such a situation, the separation device 43 arranged below (downstream of) the nip exit separates and guides the sheet from the pressure roller 14 toward the conveyance path.

Figure 5:
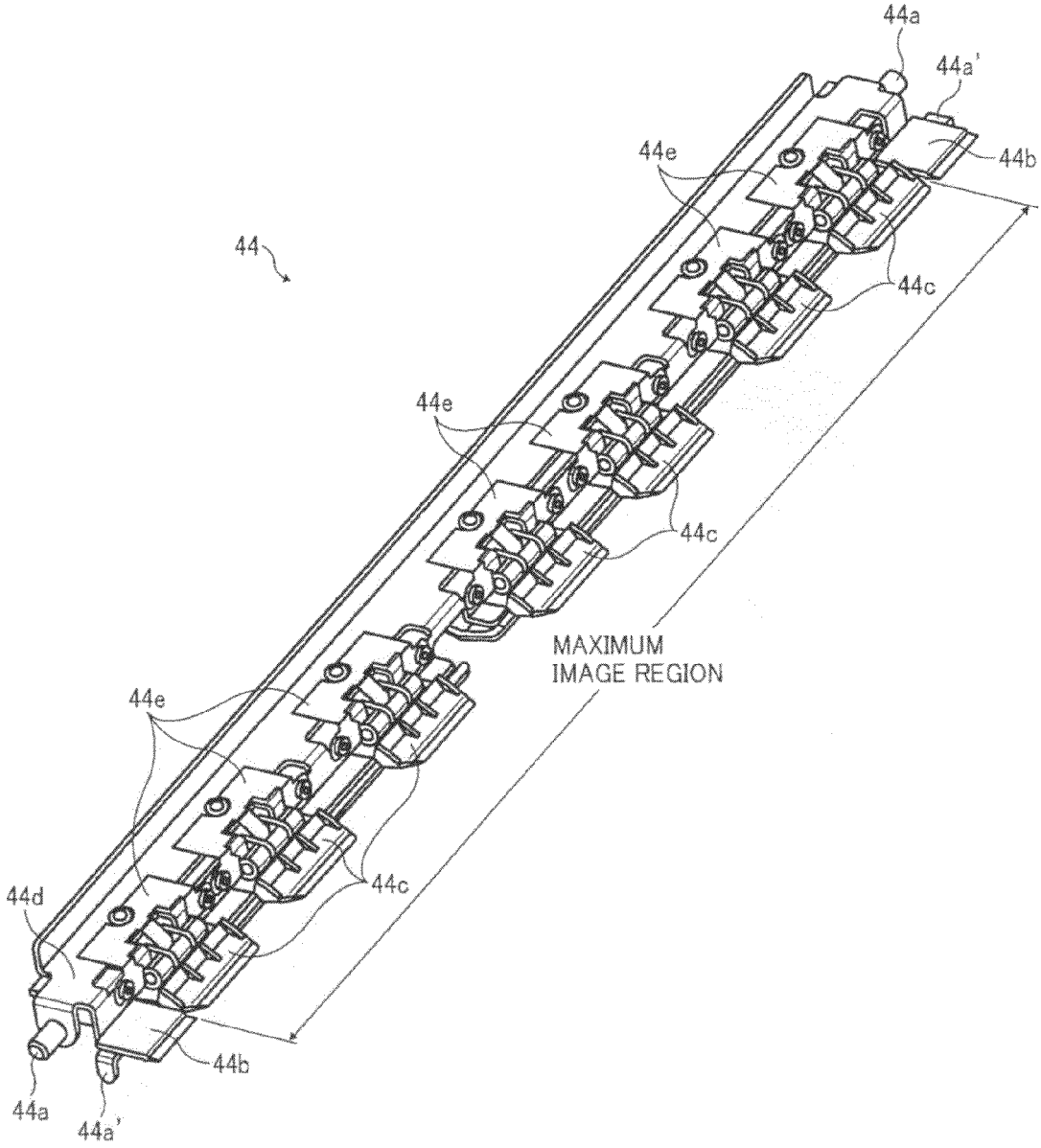
FIG. 5 illustrates an exemplary separation device arranged on the fixing belt side in the fixing device of FIG. 1.

A pressing belt system can be employed instead of pressure roller in the fixing device of FIG. 5. For example, in such a situation, the system includes plural rollers and a pressing belt wound around these rollers. Further, one of the plural rollers presses against the fixing roller 12 via the pressing belt and the fixing belt 11.

Now, an exemplary embodiment of an image forming apparatus employing the above-mentioned fixing device 5 is described. The image forming apparatus also includes a brilliance-applying device at downstream of the fixing device. The bad includes a first rotational member having a heating device and a second rotational member pressing against the first rotational member capable of creating a nip for applying brilliance to toner.

Figure 12:
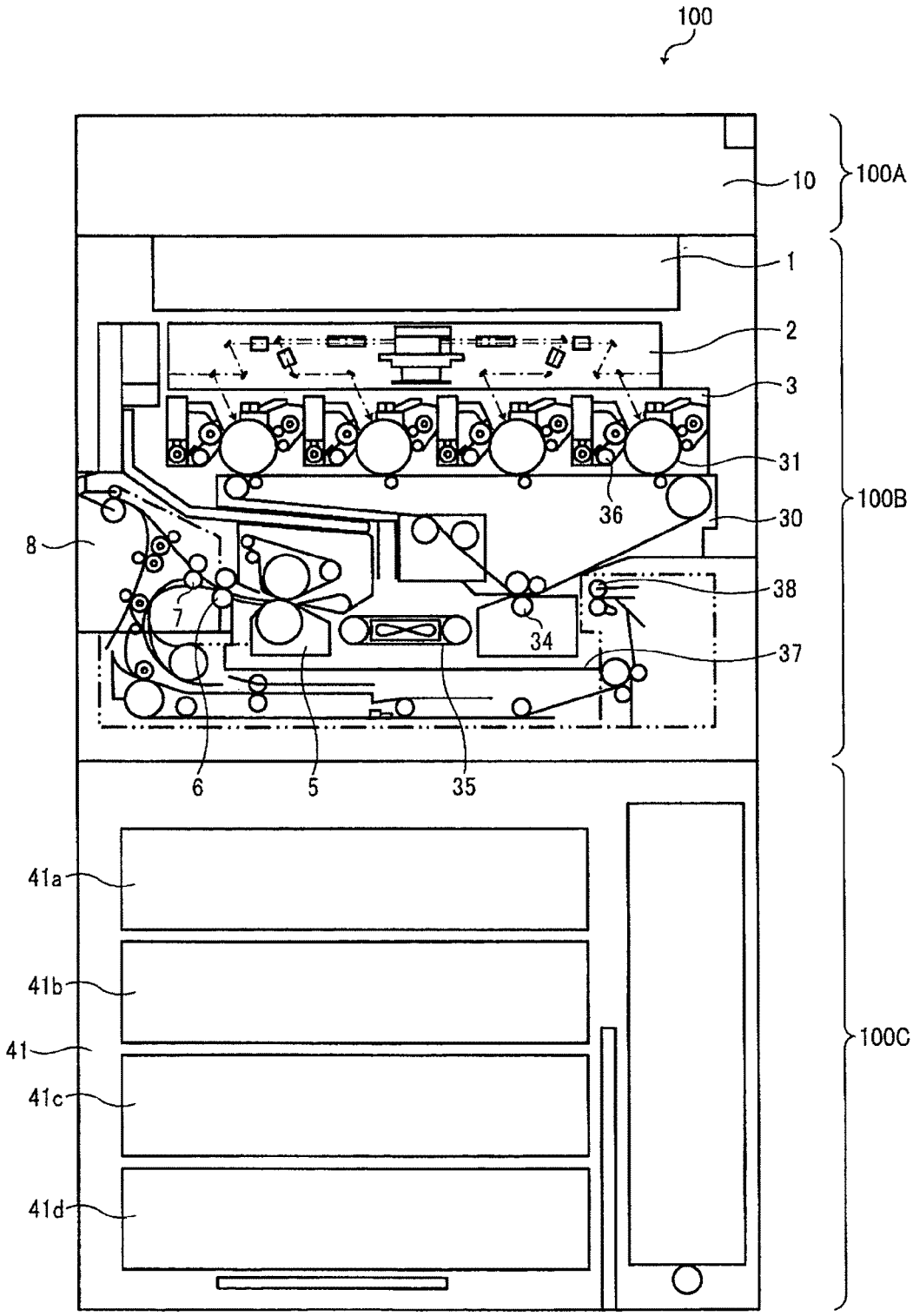
FIG. 12 illustrates an exemplary image forming apparatus according to one embodiment of the present invention.

Now, an exemplary color digital copier is described as one example of the image forming apparatus with reference to FIG. 12. A image forming apparatus 100 includes an image reading section 100A arranged at an upper portion of the apparatus body, an image formation section 200B arranged in the middle thereof, and a sheet feeding section 200C arranged at a lower portion thereof.

The image reading section 100A includes a scanner section 1 that optically reads image information of an original document, an auto document feeder 10 that successively conveys the original documents toward the scanning section 1.

A belt type intermediate transfer member 30 having a horizontally extending transfer plane is provided in the image formation section 1003. A structure for forming images of complementary colors to composed colors is arranged above the intermediate transfer member 30. Specifically, four photoconductive members 31 are arranged side by side along the transfer plane as image bearers capable of carrying toner images of colors (yellow, magenta, cyan, and black) of the complementary colors.

Above the photoconductive member 31, there are provided a writing section 2 for emitting exposure lights to the photoconductive members in accordance with scanned or externally inputted image information. The respective photoconductive members 31 are drum types rotating counterclockwise. Around each of the photoconductive members 31, there are provided a developing device section 3 having a charge device, a developing device, and a printing medium transfer device for collectively executing image formation processing as the drum rotates, as well as a cleaning section 36 that collects toner remaining on the photoconductive member 31 after a transfer process. The developing devices store respective color toners.

The intermediate transfer member 30 is wound around the drive and driven rollers and is movable in the same direction as the respective photoconductive members 31 rotate at opposing sections. Further, a secondary transfer section 34 serving as a transfer roller is arranged opposing the one of the driven rollers. On the path line of sheet conveyance from the secondary transfer section 34, there are provided a conveyance belt 35, a fixing device 5, a brilliance application device 6, and a pair of rollers 7 in this order.

The sheet feeding section 200C includes a sheet feeding tray (i.e., a group of sheet feeding trays 41*a* to 41*d*) for accommodating plural sheets, and a conveyance mechanism having a conveyance path 37 for conveying the sheet separated in turn from the uppermost one of them in the sheet feeding tray 41, and a registration section 38 for correcting skew of the sheet and synchronize the same with an image on the photoconductive member.

When an image is formed by the image forming apparatus 100, the char devices of the developing sections 3 initially uniformly charge the surfaces of the photoconductive members 31, and latent images are formed thereon by the writing devices in accordance with scanner or external image information. The latent images are visualized into toner images by the developing devices storing toner of respective colors, and are transferred onto the intermediate transfer member 30 in the secondary transfer process by the primary transfer devices, which receive prescribed biases. That is, the respective color images are superimposed in turn by electrostatic force onto the intermediate transfer member 30.

Then, the toner images on the intermediate transfer member 30 are transferred at the secondary transfer section 34 onto a sheet conveyed thereto. The sheet with the toner image is further conveyed to the fixing device 5 and receives fixing at the fixing nip section created between the fixing member and the pressing member. Then, the fixing toner on the sheet is provided with brilliance by the brilliance application device 6 upon need, and is conveyed and launched into the sheet ejection path from the sheet ejection section 18 by the pair of conveyance rollers 7. The sheet as an output image is ejected after that out of the apparatus body, whereby a series of image formation process is completed.

Thus, in the image forming apparatus, sophisticated fixing and brilliance application functions can be obtained when various types of sheets from thin to thick ones are used and brilliance and non-brilliance images are formed while maintaining high sheet productivity.

Figure 13:
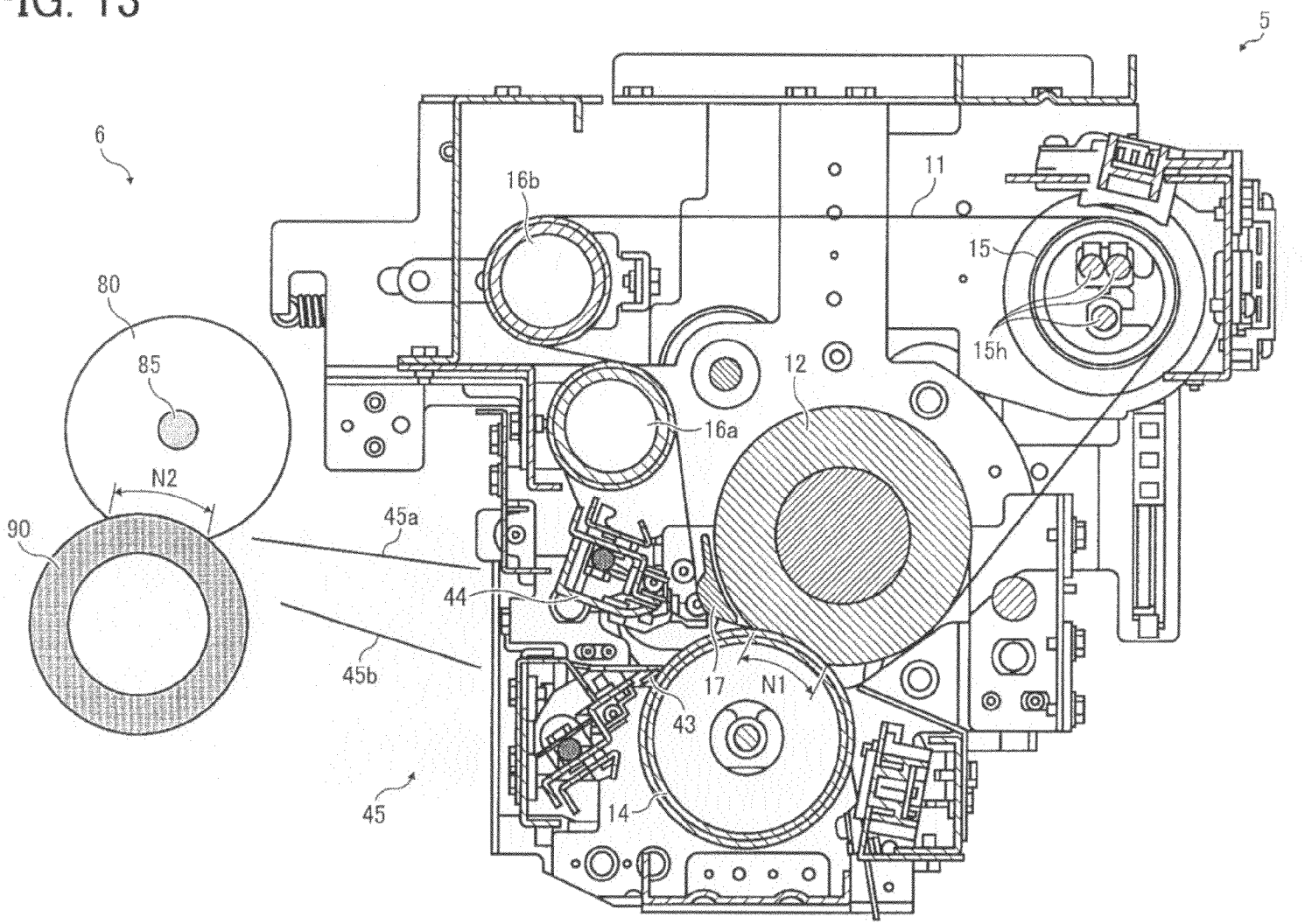
FIG. 13 illustrates a first exemplary principal configuration of the image forming apparatus of FIG. 12.

Now, a first exemplary color image forming apparatus is briefly described with reference to FIG. 13. As shown, the image forming apparatus 100 includes modes each for either or not providing brilliance to an image on the sheet. Specifically, the image forming apparatus includes a fixing device 5 having a fixing member (e.g. a fixing belt 11) and a pressing member (e.g. a pressure roller 14) pressing against and creating a fixing use nip section N1 (i.e., a fixing nip section) on the fixing member, and a brilliance application device 6 having a first rotational member (e.g. a heating roller 80) with a heating device (e.g. a heater 85) and a second rotational member (e.g. the pressure roller 90) pressing against and creating a brilliance application use nip section N2 (i.e., a brilliance application nip section) on the first rotational member on a path line for sheet conveyance.

When brilliance is not applied to an image on the sheet, the brilliance application device 6 conveys the sheet by decreasing nip pressure applied between the heating roller 80 and the pressure roller 90 less than when applying the same thereto in the brilliance application mode.

Now, a second exemplary color image forming apparatus is briefly described with reference to FIG. 14. As shown, the image forming apparatus 100 includes modes each for either or not providing brilliance to an image on the sheet. Specifically, the image forming apparatus includes a fixing device 5 having a fixing member (e.g. a fixing belt 11) and a pressing member (e.g. a pressure roller 14) pressing against and creating a fixing use nip section (i.e., a fixing nip section) N1 on the fixing member, a brilliance application device 6 having a first rotational member (e.g. a heating roller 80) with a heating device (e.g. a heater 85) and a second rotational member (e.g. the pressure roller 90) pressing against and creating a brilliance application use nip section N2 (i.e., a brilliance application nip section) on the first rotational member, and a pair of conveyance rollers 7 arranged within a distance L1 of 210 mm from the trailing end of the nip section N2 of the fixing device for conveying sheets on a path line PL for sheet conveyance use in this order.

When brilliance is not applied to an image on the sheet, and the length of the sheet in the conveyance direction is less than 210 mm, the brilliance application device 6 conveys the sheet by decreasing nip pressure applied between the heating roller 80 and the pressure roller 90 less than when applying the same therebetween in the brilliance application mode.

Whereas, when the length of the sheet in the conveyance direction is not less than 210 mm, the brilliance application device 6 separate the heating roller 80 and the pressure roller 90, so that the pair of conveyance rollers 7 convey the sheet.

Now, the fixing device 5 is more specifically described below. In the fixing device 5, the surface of the fixing belt 11 is heated to a prescribed level while the fixing belt 11 and the pressure roller 14 are driven rotated. Then, a sheet carrying not fixed toner T is passed through the nip section N1 from right to left in the drawing, and is fused and fixed onto the sheet by heat and pressure at the nip section N1, whereby the fixing process is achieved. Then, the sheet with the thus fixed toner is ejected from the nip while being separated by the separation devices 43 and 44 from the pressure roller 14 and the fixing belt 11, respectively.

The sheet ejected from the fixing device 5 is conveyed to the brilliance application device 6. In such a situation, a guide plate 45 having two sheets of plate like members is preferably arranged vertically sandwiching the path line PL, preferably narrowing a gap there between for guiding the sheet toward the brilliance application device 6 between the fixing device 5 and the brilliance application device 6. Thus, even if the sheet ejected from the fixing device 5 is curled, the guide plate 45 correct the same and directs the sheet leading end along the conveyance path, so that wrinkle and jam can be avoided in the brilliance application device 6. As a result, sheet conveyance quality can be maintained. Further, since the toner is sufficiently fused on the sheet by the fixing device 5, the image quality is not spoiled even if the guide plate 45 contacts the image during the conveyance.

Now, the brilliance application device 6 is more specifically described below. The brilliance application device 6 includes a hollow cylindrical first rotational member (e.g. a heating roller 80) including a heating device (e.g. a heater 85), and a second rotational member (e.g. the pressure roller 90) pressing against the first rotational member and creating a brilliance application use nip section N2 thereon, which is capable of applying brilliance to an mage on the sheet.

The heating roller 80 includes a cylindrical core metal made of aluminum or iron and the like, an elastic layer made of such as silicon rubber, etc., overlaying the core metal, and a heater 85 installed in the core metal. The pressure roller 90 includes a bar like core metal made of aluminum or iron and the like, and an elastic layer made of such as silicon rubber, etc., overlaying the core metal.

A temperature detection sensor 82 is arranged to detect surface temperature at a section adjacent to an inlet of the nip section N2 of the heating roller 80. Thus, based on temperature detected by the sensor 82, a heater of a heating device 85, such as halogen heater, etc., can be turned on and off and the surface temperature of the heating roller 80 can be maintained at a prescribed level.

The surface temperature of the heating roller 80 contacting a toner image on the sheet is controlled for appropriately providing brilliance to the toner image in a brilliance application mode. For example, the surface temperature of the heating roller 80 is less than that of the fixing member (i.e., the fixing belt 11) of the fixing device 5. Otherwise, the surface temperature of the heating roller 80 is preferably not less than that of the sheet at the time of entering the brilliance application device 6 and not more than that of the sheet just ejected out of the fixing device 5.

Yet otherwise, the surface temperature of the heating roller 80 is preferably not less than softening temperature of toner when tested by a flow tester not more than half flowage start temperature, and further preferably, not less than the softening temperature and not more than flowage start temperature. These toner physicality temperatures can be obtained using a flow tester (CFT-500D, manufacture by SHIMADZU CORPORATION) based on a relation between temperature and a piston stroke on conditions that load is 5 Kg/cm$^2$, temperature warming speed is 3.0 degree centigrade/mini, a die opening diameter is 1.00 mm, and a die length is 10.0 mm, for example. The above-mentioned half flowage start temperature represents a middle point between the flowage start and complete temperatures.

Specifically, the surface temperature of the heating roller 80 is preferably from 60 to 137 degree centigrade (i.e. from softening temperature as physical temperature of usage toner to half of flowage start temperature as physical temperature of usage toner), and is more preferably from 60 to 120 degree centigrade (i.e. flowage start temperature as physical temperature of usage toner), and is further preferably from 80 to 100 degree centigrade. The above-mentioned temperature of the toner as toner physical temperature represents an average because of its fluctuation depending on a toner lot or color.

When the sheet passes through the fixing device 5 in the fixing process in the image forming apparatus 100, not-fixed toner receives heat and pressure at the nip section N1 thereof, and accordingly, a toner is entirely fused from its surface up to the sheet, whereby fixing is completed. Thus, the toner is smoothed and comes to tightly stick to the sheet, so that the toner surface also has intensive adhering force.

In contrast, when the sheet passes through the brilliance application device 6 in the brilliance application process, only calorie is provided to the toner only to level the surface thereof, because the fixing has been completed. The above-mentioned leveling represents improvement of a brilliance degree by smoothing the toner surface. Even though the toner on the sheet entering the brilliance application device 6 receives heat and pressure at the nip section N2, since the surface temperature of the heating roller 80 is preferably not less than that of the sheet at the time of entering the brilliance application device 6 and not more than that of the sheet just ejected out of the fixing device 5 (or not less than the softening temperature tested by the toner flow tester and more than the half of flowage start temperature, or from 60 to 120 degree centigrade), the toner layer is not completely fused but only the surface layer is softened.

As a result, the toner maintains its color as is, and only the surface layer is leveled by the smooth surface of the heating roller 80 while improving brilliance. Since the adhering force of the toner surface is less than that in the fixing process, sheet separation performance is excellent even if the diameter of the heating roller 80 is not less than 30 mm to not more than 40 mm. Specifically, the separation member 83 arranged on the sheet ejection side of the brilliance application device 6 can be omitted, whereby the apparatus body is downsized at low cost. Further, since offset generally caused when the toner layer is entirely fused as in the foxing process does not occur, the clean member for removing toner stain on the surface of the pressure roller 90 can be omitted, whereby the apparatus body is downsized at low cost, too.

In the image forming apparatus of this embodiment, depending on the type, thickness, and conveyance speed of the sheet, the fixing is not necessarily completed when the sheet passes through the fixing device 5. Specifically, the fixing device 5 is regarded as a first step fixing device and the brilliance application device 6 is regarded as a second step fixing device, so that the fixing is completed by these two steps of the fixing devices.

This is efficient when a thick sheet not less than 124 g/m2 is conveys at high speed. P Further, the pressure roller 90 includes a pressing adjustment device having a pressing lever 96, a spring 97, a pressing intermediate member 96*a*, and a cam 98.

Figure 14:
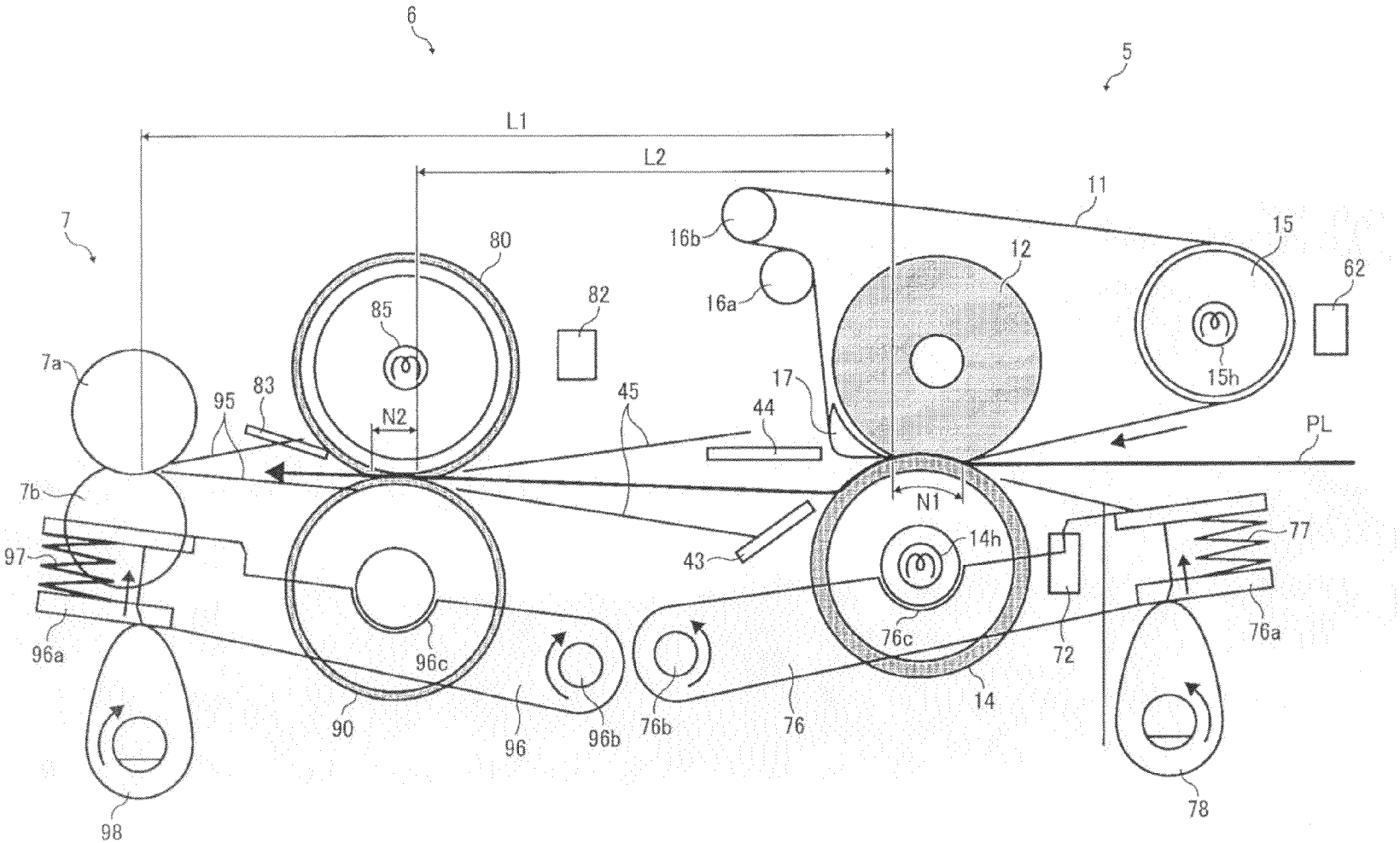
FIG. 14 illustrates a second exemplary principal configuration of the image forming apparatus of FIG. 12.

Thus, in the brilliance application mode, the pressing adjustment device causes the pressure roller 90 to depress the pressure roller with a prescribed pressure as shown in FIG. 14.

Specifically, when the cam 98 is rotated by an externally provided driving force by a prescribed angle in a direction as shown by an arrow in the drawing, it lifts up the pressing intermediate member 96*a* in a direction as shown by an arrow in the drawing. Then, the spring 97 secured to the 96*a* lifts up an end of the pressing lever 96 with prescribed pressure. Thus, the pressing lever 96 swings around the supporting shaft 96*b* as a rotational center i.e., clockwise in FIG. 14. Then, a pressing section 96*c* existing at a middle point of the end of the pressing lever 96 on the side of the spring 97 and the supporting shaft 96*b* contacts and pushes the shaft of the pressure roller 90 toward the heating roller 80. Finally, the pressure roller 90 contacts the heating roller 80 with a prescribed pressure and creates a nip for the brilliance application use thereon. The spring 97 can be omitted and the cam 98 instead directly lifts up the pressing lever 96.

Adjustment of the pressure of the pressing adjust device can be executed by controlling a rotational angle of the cam 98. Specifically, by bringing the cam 98 to a prescribed rotational position, the heating roller 80 and the pressure roller 90 can be separated and the nip section N2 is opened.

The nip pressure applied to the nip section N2 is preferably set to 15 to 30N/cm$^2$ by the pressure-adjusting device in the brilliance application mode. As a result, when the sheet conveyed from the fixing device 5 passes through the brilliance application device 6, the leveling of the fixing toner surface layer is executed by applying heat and prescribed pressure to the fixing toner at the nip section N2, brilliance is provided thereto.

Whereas, when the brilliance is not applied, the nip pressure is adjusted by the pressure-adjusting device to be less than that applied in the brilliance application mode and is applied to the nip section N2. For example, the nip pressure is preferably adjusted less than 15N/cm$^2$, and is more preferably adjusted less than 5N/cm$^2$. The above-mentioned nip pressure represents an average of that of the entire width. Thus, since the nip pressure is weak even if the sheet is nipped between the heating roller 80 and pressure roller 90, the system functions simply as a sheet conveyance apparatus without increasing the brilliance of the image.

Further, when a sheet longer than a prescribed reference level in the conveyance direction is used in the non-brilliance application mode, the pressure adjusting device preferably provides an opening between the heating roller 80 and the pressure roller 90, and the pair of conveyance rollers 7 preferably conveys the sheet in the brilliance application device 6 as shown in FIG. 14. Further, when a sheet shorter than the prescribed reference level in the conveyance direction is used in the non-brilliance application mode, the pressure-adjusting device preferably decreases the nip pressure to be less than that used in the brilliance application mode, and the sheet is conveyed in the brilliance application device 6.

The reference length is preferably determined based on an apparatus layout (i.e., distance L1 and L2) of the image forming apparatus 100. For example, the reference length is the maximum sheet length capable of appropriately conveying the sheet such that a leading end of the sheet launched from the nip of the fixing device 5 arrives at the pair of conveyance rollers 7 before the trailing end of the sheet exits from the nip when the heating roller 80 and the pressure roller 90 are separated in the brilliance application device 6 of the image forming apparatus 100, a layout of which has been determined. Otherwise, it is the sum of the maximum sheet length and a prescribed value added considering apparatus performance.

When the reference length is a longitudinal length of B5 size sheet (JIS) or the widthwise length of B4 size sheet (JIS) (i.e., 257 mm), or when the sheet length less than 257 mm (i.e. widthwise length of A4 size sheet fed in a widthwise direction) is used in the non-brilliance application mode, the pressure-adjusting device decreases the nip pressure of the nip section N2 less than that used when the brilliance is applied in the nip N2 as mentioned above. The pressure-adjusting device provides an opening between the heating roller 80 and the pressure roller 90 (i.e., the nip section N2) when the sheet length is not less than 257 mm in the non-brilliance application mode.

Otherwise, when the reference length is a widthwise length of A4 size sheet (JIS) (i.e., 210 mm), or when the sheet length less than 210 mm is used in the non-brilliance application mode, the pressure-adjusting device decreases the nip pressure of the nip section N2 less than that used when the brilliance is applied in the nip N2 as mentioned above.

The pressure-adjusting device provides an opening between the heating roller 80 and the pressure roller 90 (i.e., the nip section N2) when the sheet length is not less than 210 mm in the non-brilliance application mode.

The above-mentioned reference length is not limited to that corresponding to the sheet size as mentioned above. Specifically, the reference length can be 200 mm. In such a situation, when the reference length is less than 200 mm is used in the non-brilliance application mode, the pressure-adjusting device decreases the nip pressure of the nip section N2 less than that used when the brilliance is applied in the nip N2 as mentioned above. The pressure-adjusting device provides an opening between the heating roller 80 and the pressure roller 90 (i.e., the nip section N2) when the sheet length is not less than 200 mm in the non-brilliance application mode.

Otherwise, the reference length can be appropriately designated from among prescribed values derived from an apparatus layout. Specifically, when distances are determined (according to the app layout) such that L1=210 mm and L2≦182 mm, the values derived therefrom can range from 182 to 210 mm, and the reference length can be chosen among them as being 200 mm. In such a situation, when the sheet of B5 size sheet (JIS) having a widthwise length of 182 mm is fed in a widthwise direction in the non-brilliance application mode, the pressure adjusting device decreases the nip pressure of the nip section N2 less than that in the brilliance application mode. Whereas, when the sheet of A4 size sheet (JIS) having a widthwise length of 210 mm is fed in a widthwise direction, the pressure adjusting device provides an opening betweens the heating roller 80 and the pressure roller 90 (i.e., the nip section N2).

Further, the reference length can be a length of the minimum sheet that causes fine wrinkle in the non-brilliance application mode due to bending or tension created between the fixing device 5 and the brilliance application device 6 by a difference of a line speed.

The A3 size sheet (JIS) having a basic weight of 80 g/m$^2$ is sometimes used in the non-brilliance application mode, and causes fine wrinkle or the like due to bending or tension created between the fixing device 5 and the brilliance application device 6 because of a few differences of a line speed. Thus, the heating roller 80 is separated from the pressure roller 90 in the brilliance application device 6 to resolve such a problem. Although the sheet simply passes through the brilliance application device 6, since the length of the sheet is more than the reference length (e.g. 210 mm), the leading end of the sheet launched from the nip section N1 of the fixing device 5 arrives at the pair of conveyance rollers 7 to be nipped and conveyed by the pair of conveyance rollers 7. Thus, a chance when an image formed contacts the roller is decreased and image quality is maintained, so that the sheet can be precisely conveyed. In such a situation, the distance L1 is designated less than the reference length in the image forming apparatus 100.

Further, the heating roller 80 is preferably separated from the pressure roller 90 to make a gap (i.e., a roller gap) not more than 2 mm. Specifically, if the roller gap is more than 2 mm, the sheet deviates from the path line PL and causes jamming readily.

Further, surface layers of the heating roller 80 and the pressure roller 90 are preferably coated by fluorine resin, respectively. As a result, not only the releasability of the sheet is improved, but also occurrence of image grinding or the like caused when the sheet is conveyed through the roller gap of not more than 2 mm formed between the heating roller 80 and the pressure roller 90 and an image surface partially contacts the heating roller 80 in the non-brilliance application mode.

Because, a surface layer 80*a* made of the fluorine resin exerts the releasability.

Hence, according to the above-mentioned configuration of the brilliance application device 6, a prescribed brilliance can be always and precisely obtained both in the brilliance and non-brilliance application modes.

Further, the brilliance application device 6 is arranged such that the distance L2 from the trailing end of the nip section N1 and the leading end of the nip section N2 is preferably not less than 50 mm, more preferably from 60 to 182 mm, yet preferably from 70 to 150 mm, further preferably from 80 to 100 mm.

Specifically, if the distance L2 is less than 50 mm, an inclination of the guide plates 45 is too sharp and likely causes jam. Because, intervals of respective inlet and outlet of the guide plates 45 are fixed. The lower limit of the distance L2 varies in accordance with configurations of the image forming apparatus 100 and the nip sections of the devices 5 and 6.

The upper limit of the distance L2 is preferably the minimum sheet length. For example, L2 of 182 mm is a distance to handle when the B5 size sheet (JIS) is conveyed in the widthwise direction. The upper limit of L2 is 150 mm, when a half letter size sheet is conveyed in the widthwise direction. The upper limit of L2 is 100 mm, when a postcard size sheet is conveyed in the widthwise direction.

When the widthwise length of the A4 size sheet serves as the minimum sheet length, the upper limit of the distance L2 can be 210 mm. Otherwise, when the length of the B5 size sheet in a longitudinal direction serves as the minimum sheet length, the upper limit of the distance L2 can be 257 mm. In such situations, the upper limit of the distance L1 needs to be changed in accordance with the upper limit of the distance L2.

When the sheet ejected from or passing through the brilliance application device 6 is then conveyed to the pair of conveyance roller 7 as mentioned.

In such a situation, a guide plate 95 having two sheets of plate like members vertically arranged upper and lower sides of the path line PL between the device 5 and the pair of conveyance roller 7 is preferably arranged narrowing the gap therebetween toward the pair of conveyance rollers 7 for guiding the sheet. Further, since the guide plate 95 corrects curl or the like and the sheet is properly directed in the conveyance direction, wrinkle and jam can be avoided in the brilliance application device 6, and sheet conveyance quality can be maintained.

Now, the pair of conveyance roller is more specifically described below. The pair of conveyance roller 7 includes a cylindrical roller 7*a* made of chloroprene rubber or silicon rubber or the like, and a cylindrical roller 7*b* made of resin engaging with cylindrical roller 7*a*. One or all of the both cylindrical rollers 7*a* and 7*b* driven rotate and conveyance the sheet by pinching therebetween toward the ejection path. Further, since the pair of roller 7 are arranged within the reference length (e.g. 210 mm) from the trailing end of the nip N1 of the fixing device 5, a leading end of the sheet launched from the nip N1 of the fixing device 5 can arrive at the pair of conveyance rollers 7 before the trailing end of the sheet exits from the nip even when the convey direction length of the sheet is more than the reference length (e.g. 210 mm (corresponding to a length of widthwise dire of the A4 size sheet)), and thus, the heating roller 80 and the pressure roller 90 are separated from each other in the brilliance application device 6 of the image forming apparatus 100.

Further, in this embodiment, the surface temperature of the heating roller 80 of the brilliance application device 6 is set to a relatively low level, e.g., the surface temperature of the heating roller 80 is not less than that of the sheet at the time of entering the brilliance application device 6 and not more than that of the sheet just ejected out of the fixing device (or not less than the softening temperature tested by the toner flow tester, and not more than the half of flowage start temperature, or from 60 to 120 degree centigrade), temperature of the sheet arriving at the pair of roller 7 is the same or less than that of the sheet just ejected out of the fixing device 5 in the brilliance application mode. As a result, the toner is prevented from firmly securing to the pair of roller 7. For the same reason, the toner is prevented from firmly securing to the guide plate 95 or the like.

Now, both of the brilliance and non-brilliance application modes are described more in detail. In this embodiment, using the same basic weight sheet, both of modes for applying or not applying brilliance are selectively executed. Specifically, two modes are displayed on a display monitor for a user to choose. The brilliance application mode represents that a high brilliance level (30 to 50%) sheet, such as a coat sheet, etc., is used, and an image (i.e., a fixing toner image) is formed thereon, while almost the same level brilliance is applied to the toner image as the background as preferably employed in graver photograph printing. The non-brilliance application mode represents that a not high brilliance level sheet, such as a plain paper sheet, etc., is used, and an image is formed thereon without applying the brilliance thereto.

When the brilliance application mode is selected, the below-described process is executed using a coat sheet having a brilliance level of 30 to 50%. Herein below, an exemplary operation executed by the apparatus of FIG. 14 when the distances L1 and L2 are 210 mm and 60 to 182 mm, respectively, is described. In step S11, a sheet carrying not-fixed toner is conveyed and the fixing device 5 fixes the toner. At this moment, the fixing belt 11 is heated by the heater 15*h* arranged in the heating roller 15 to a prescribed level capable of appropriately executing the toner fixing. The nip section N1 is adjusted by the cam 78 as a pressing device to have nip pressure 15 to 30 N/cm2 with a prescribed nip width. Thus, the toner on the sheet passing through the fixing device 5 is completely fixed with brilliance of more than 25%. In step S12, curl or the like of the sheet ejected out of the fixing device 5 is corrected by the guide plate 95 and the leading end thereof is appropriately conveyed to the brilliance application device 6. In step S13, the brilliance application device 6 further provides brilliance to the image on the sheet. At this moment, the surface temperature of the heating roller 80 is 80 to 100 degree centigrade while the nip pressure is adjusted by the pressure-adjusting device to be 15 to 30N/cm2.

Thus, when the sheet passes through the nip section N2 of the brilliance application device 6, the fixing toner receives prescribed heat and pressure and the surface layer thereof is leveled. Thus, brilliance of +/−1.5%, preferably +/−10% of the sheet is applied to the fixing toner. In step S14, the sheet ejected from the brilliance application device 6 is then ejected from the conveyance path via the guide plate 95 and the pair of roller 7.

When the not brilliance application mode is selected, a size of the sheet is detected and the below mentioned operation selectively is executed if the length of the sheet is less than 210 mm or not. Initially, a situation in which the length of the sheet is less than 210 mm is described. In step S21, a sheet carrying not-fixed toner is conveyed and the fixing device 5 fixes the toner. At this moment, the fixing belt 11 is heated by the heater 15*h* installed in the heating roller 15 to a prescribed level capable of appropriately execute the toner fixing. Further, the nip section N1 is adjusted by the cam 78 as a pressing device to have nip pressure of 15 to 30N/cm2 with a prescribed nip width narrower than that in the brilliance application mode. Thus, the toner on the sheet passing through the fixing device 5 is completely fixed without largely increasing the brilliance. Otherwise, depending on the type of sheets, the condition of the fixing device 5 can be the same as in the brilliance application mode. In step S22, curl or the like of the sheet ejected out of the fixing device 5 is corrected by the guide plate 95 and the leading end thereof is appropriately conveyed to the brilliance application device 6.

In step S23, the brilliance application device 6 pinches and further conveys the sheet at the nip N2. At this moment, the surface temperature of the heating roller 80 is 80 to 100 degree centigrade, and the nip pressure is adjusted by the pressure-adjusting device to be not more than that in the non-brilliance application mode, to be not more than 5N/cm2, for example. Thus, by decreasing the pressure when the sheet passes through the nip section N2 of the brilliance application device 6, the fixing toner does not receive much heat and pressure, so that the brilliance of the fixing toner is not increased. In step S24, the sheet ejected from the brilliance application device 6 is then ejected from the conveyance path via the guide plate 95 and the pair of roller 7.

Now, a situation in which the brilliance application mode is selected and the length of the sheet is not less than 210 mm in the conveyance direction is described. In step S31, a sheet carrying not-fixed toner is conveyed and the fixing device 5 fixes the toner. At this moment, the fixing belt 11 is heated by the heater 15*h* installed in the heating roller 15 to a prescribed level capable of appropriately execute the toner fixing. Further, the nip section N1 is adjusted by the cam 78 as a pressing device to have nip pressure of 15 to 30N/cm$^2$ with a prescribed nip width narrower than that in the brilliance application mode. Thus, the toner on the sheet passing through the fixing device 5 is completely fixed without largely increasing the brilliance. In step S32, curl or the like of the sheet ejected out of the fixing device 5 is corrected by the guide plate 45 and the leading end thereof is appropriately conveyed to the brilliance application device 6. In step S33, in the brilliance application device 6, the heating roller 80 and the pressure roller 90 are separated from each other to have a prescribed gap of not more than 2 mm, so that the sheet passes through the gap therebetween. In step S34, the sheet passing through the brilliance application device 6 then passes through the guide plate 95 and arrives at the pair of rollers 7. Since the pair of conveyance rollers 7 are arranged within a distance of 210 mm from the trailing end of the nip section N1 of the fixing device 5, the leading end of the arrives at the pair of rollers 7 before the trailing end thereof is launched from the nip section N1, whereby the pair of conveyance rollers 7 pinch and appropriately convey the sheet continuously. The sheet launched out of the pair of rollers 7 is ejected via the conveyance path.

As mentioned heretofore, in either of situations in which the brilliance application mode is selected and the length of the sheet is either less than or not less than 210 mm in the conveyance direction, the brilliance of the toner on the sheet is not increased in the devices 5 and 6 while conveying the sheet stably. Thus, the path line of the sheet conveyance does not need to be changed while forming an image with prescribed brilliance. As a result, the image forming apparatus can be downsized.

Further, it is possible in the brilliance application mode to obtain not less than 30 mili second, preferably 60 mili second, as a nipping time period in the fixing device 5, while obtaining not less than 15 mili second as a nipping time period in the brilliance application device 6. Thus, the same sheet productivity can be obtained in the brilliance application mode as in the non-brilliance application mode. Thereby, high productivity can be maintained regardless of the mode.

An exemplary modification of the configuration of FIG. 14 is now briefly described.

Specifically, instead of the brilliance application device 6 of the configuration of FIG. 14, a secondly fixing device can be provided to create a secondary nip section that applies heat and pressure to toner surface carried on a sheet, such that these fixing devices collectively complete the fixing of the toner onto the sheet. The brilliance application device 6 can simply be omitted therefrom.

Figure 15:
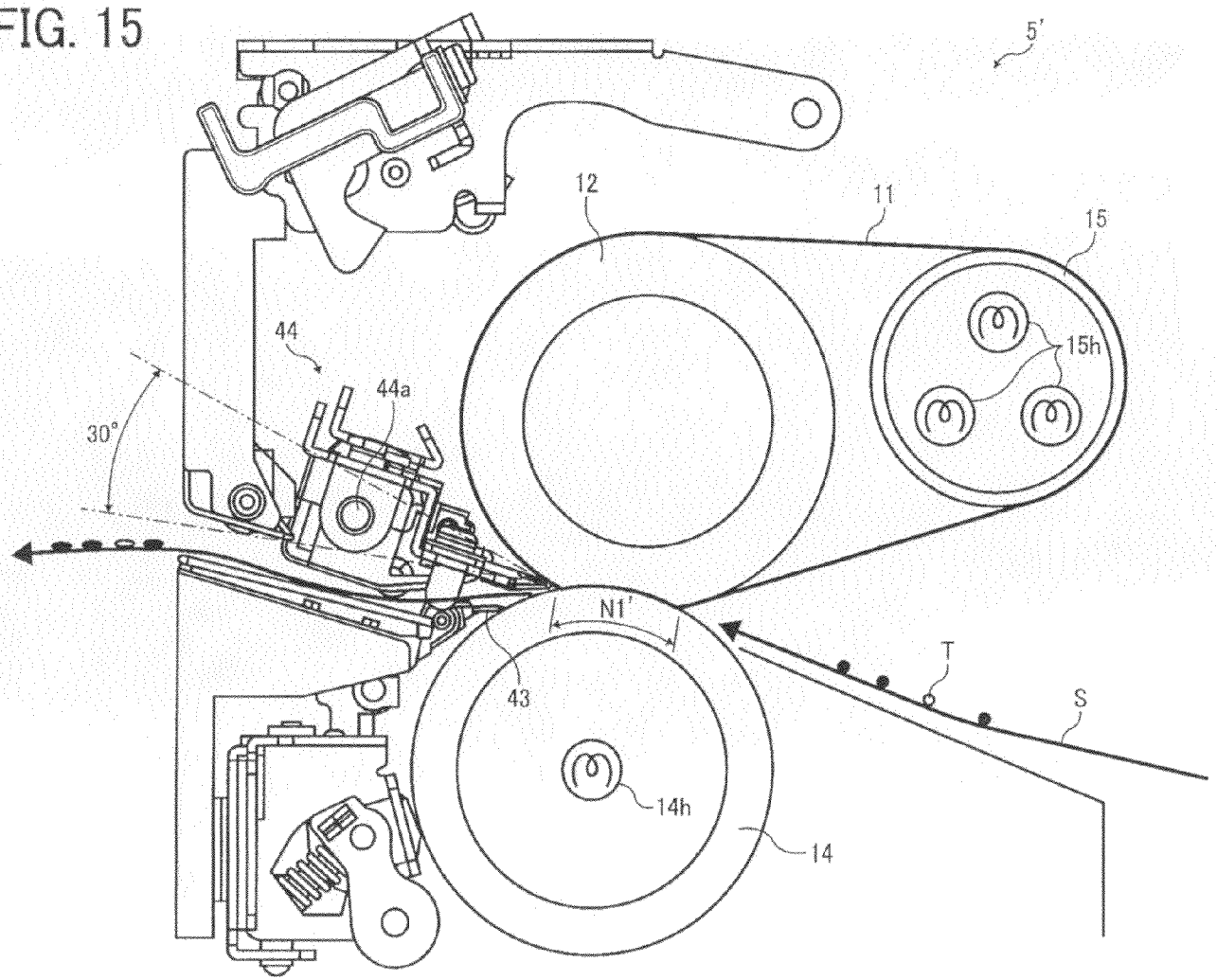
FIG. 15 illustrates an exemplary fixing device employing the separation device of FIG. 5.

Further, the above-mentioned separation device 44 can be applied to another system beside that of the fixing device 5 as show in FIG. 15. As shown, the slip supporting member 17 and the pair of tension rollers 16*a* and 16*b* are omitted in the fixing device 5 with the rest of those being the same configuration. Specifically, a fixing device 57 is provided and includes a rotatable fixing member (e.g. a fixing belt 11), a pressure roller 14 pressing against and creating a nip section N1' on the fixing member, and a separation member (e.g., a separation plate 44*c*) separating a sheet S ejected from the nip section N1'. Also provided are a strike member 44*b*, a leading end of which contacts the fixing member and holds a leading end of the separation member from the fixing member by a prescribed distance not to contact the fixing member, and a separation device having a bias device (e.g. a rotational lever 44*f*, a tension spring 44*g*) that biases the leading ends of the separation member and the strike member.

Further, the leading end section (e.g. a curvature section) of the strike member engaging with the fixing member maintains a prescribed width in the widthwise direction of the fixing member and includes a curvature shape of a cylinder shape in a rotational direction of the fixing member. A curvature radius of the leading end section is largest at the widthwise center and gradually decreases toward both ends thereof from the center. Such a fixing member includes a fixing rotational member such as a fixing belt, a fixing roller, etc. Such a pressure roller is a pressing rotational member, such as a pressure roller, a pressing belt, etc. Thus, even if the leading end section of the strike member 44*b* engages with the fixing member, the fixing member is not damaged, because of the curvature shape of the leading end section. As a result, the fixing member can have a long life maintaining excellent separation performance.

ADVANTAGE

According to one embodiment of the present invention, a gap between the fixing belt and a separation member can be precisely finely adjusted, while maintaining excellent separation performance. Further, the leading end section of the strike member 44*b* does not damage the fixing member by engaging with the fixing member via the leading end section, the fixing member can have a long life. Further, an image forming apparatus capable of handling various types of sheets maintaining a stable separation performance having a long life can be provided.

Numerous additional modifications and variations of the present invention are possible in light of the above teachings. It is therefore to be understood that within the scope of the appended claims, the present invention may be practiced otherwise that as specifically described herein.

What is claimed is:

1. A fixing device comprising:

a rotational fixing member configured to fix a toner image onto a sheet;

a pressing member configured to press against and create a nip on the fixing member;

at least one sheet separation member configured to separate the sheet ejected from the fixing nip;

at least two spacers each having a leading end configured to engage the rotational fixing member and distance the at least one sheet separation member from the rotational fixing member by an amount; and at least one biasing device configured to bias the at least one sheet separation member together with the at least two spacers toward the rotational fixing member, wherein each of leading ends of the at least two spacers has a width and a curvature in a rotational direction of the fixing member, and a radius of the curvature is largest at the widthwise center and gradually decreases toward both ends from the widthwise center in the each of the leading ends.

2. The fixing device as claimed in claim 1, wherein said at least two spacers are arranged outside of a maximum image region of the rotational fixing member, Page 2 respectively, and said at least one sheet separation member is arranged within the maximum image region.

3. The fixing device as claimed in claim 2, wherein the center of the curvature is substantially coincident with a leading end of the sheet separation member on a cross-section defined perpendicular to a widthwise direction.

4. The fixing device as claimed in claim 1, wherein said radius of the curvature is smaller at widthwise ends of the curvature than that in the widthwise center of the curvature by not less than 0.03 mm.

5. An image forming apparatus including the fixing device as claimed in claim 4.

6. A fixing device comprising:

a fixing roller configured to fix a toner image onto a sheet, said fixing roller having an elastic surface layer;

at least two rollers including the fixing roller;

an endless fixing belt wound around the at least two rollers;

a pressing member configured to press against the fixing roller via the fixing belt, said pressing member configured to create a fixing nip on the endless fixing belt;

a slip supporting member configured to press against the inner surface of the fixing belt at an exit section on a sheet conveyance path downstream of the fixing nip;

at least two separation members configured to separate the sheet ejected from the fixing nip, said at least two separation members being arranged with their leading ends being distanced from the exit section; and at least two spacers each having a leading end configured to engage the fixing roller and distance the at least two separation members from the fixing roller, wherein each of leading ends of the at least two spacers has a width and a curvature in a rotational direction of the fixing member, and a radius of the curvature varies in the each of the leading ends.

7. The fixing device of claim 6, wherein the radius of the curvature is largest at the widthwise center and gradually decreases toward both ends from the widthwise center in the each of the leading ends.

* * * * *